US007756426B2

(12) United States Patent
Kamimura

(10) Patent No.: US 7,756,426 B2
(45) Date of Patent: Jul. 13, 2010

(54) IMAGE FORMING APPARATUS, IMAGE FORMING UNIT AND DEVELOPER CARTRIDGE

(75) Inventor: Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 986 days.

(21) Appl. No.: 11/498,228

(22) Filed: Aug. 3, 2006

(65) Prior Publication Data

US 2007/0031158 A1 Feb. 8, 2007

(30) Foreign Application Priority Data

Aug. 8, 2005 (JP) ..... 2005-229905

(51) Int. Cl.
*G03G 15/00* (2006.01)
*G03G 15/04* (2006.01)
*G03G 21/18* (2006.01)

(52) U.S. Cl. ..... 399/12; 399/36; 399/113; 399/119

(58) Field of Classification Search ..... 399/12, 399/36, 31, 25, 112, 113, 24, 119
See application file for complete search history.

(56) References Cited

U.S. PATENT DOCUMENTS 6,792,217 B2 * 9/2004 Nishino et al. ..... 399/12
2005/0031359 A1 2/2005 Ishii

FOREIGN PATENT DOCUMENTS

| | | |
|---|---|---|
| JP | 6-175491 | 6/1994 |
| JP | 11-174840 | 7/1999 |
| JP | 2000-39828 | 2/2000 |
| JP | 2000-221781 | 8/2000 |
| JP | 2001-056607 | 2/2001 |
| JP | 2001-188410 | 7/2001 |
| JP | 2002-214985 | 7/2002 |
| JP | 2004-294646 | 10/2004 |
| JP | 2005-055544 | 3/2005 |

* cited by examiner

*Primary Examiner*—David M Gray
*Assistant Examiner*—Rodney Bonnette
(74) *Attorney, Agent, or Firm*—Banner & Witcoff, Ltd

(57) ABSTRACT

When a developer cartridge is mounted together with a drum unit in a main body casing, a detection gear is rotated by driving of a motor, and an abutment projection of the detection gear is brought into abutment against a lever of a drum subunit to move the lever. The movement of the lever is detected by an optical sensor. A CPU judges information on the developer cartridge on the basis of the results of the detection by the optical sensor. Therefore, the information on the developer cartridge can be judged with a simple construction at reduced costs. Further, the developer cartridge can be mounted in the main body casing in spaced relation, so that the design flexibility is increased.

32 Claims, 11 Drawing Sheets

FIG. 9 (a-1)
FIG. 9 (a-2)
FIG. 9 (a-3)
FIG. 9 (a-4)
FIG. 9 (b-1)
FIG. 9 (b-2)
FIG. 9 (b-3)
FIG. 9 (b-4)
UPPER SIDE
LOWER SIDE
FRONT SIDE
REAR SIDE
LEFT SIDE
RIGHT SIDE
X

FIG. 10 (c-1)
FIG. 10 (c-2)
FIG. 10 (c-3)
FIG. 10 (c-4)
FIG. 10 (d-1)
FIG. 10 (d-2)
FIG. 10 (d-3)
FIG. 10 (d-4)
FIG. 10 (e-1)
FIG. 10 (e-2)
FIG. 10 (e-3)
FIG. 10 (e-4)
FRONT SIDE
REAR SIDE
UPPER SIDE
LOWER SIDE
LEFT SIDE
RIGHT SIDE

FIG. 11 (a-1)
FIG. 11 (a-2)
FIG. 11 (a-3)
FIG. 11 (a-4)
FIG. 11 (b-1)
FIG. 11 (b-2)
FIG. 11 (b-3)
FIG. 11 (b-4)
FIG. 11 (c-1)
FIG. 11 (c-2)
FIG. 11 (c-3)
FIG. 11 (c-4)
UPPER SIDE
LOWER SIDE
FRONT SIDE
REAR SIDE
RIGHT SIDE
LEFT SIDE
X
Y (a-1)

(a-2)

(b-1)

(b-2)

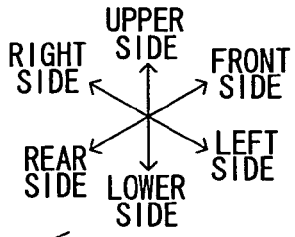
FIG. 14 (a-1)
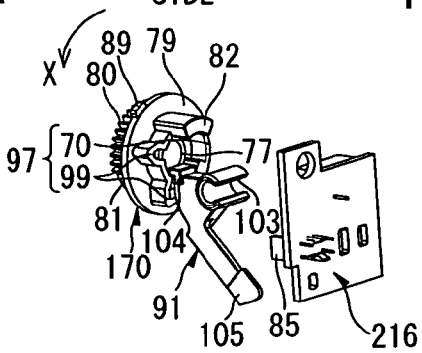
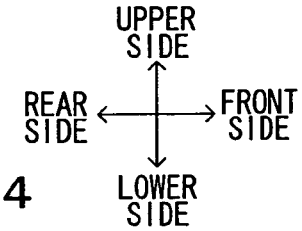
FIG. 14 (a-2)
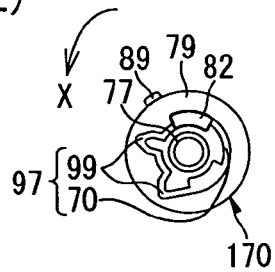
FIG. 14 (b-1)
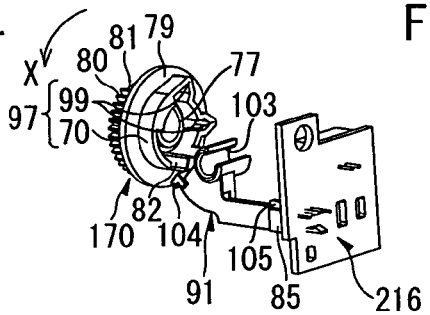
FIG. 14 (b-2)
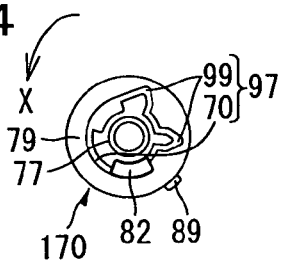
FIG. 14 (c-1)
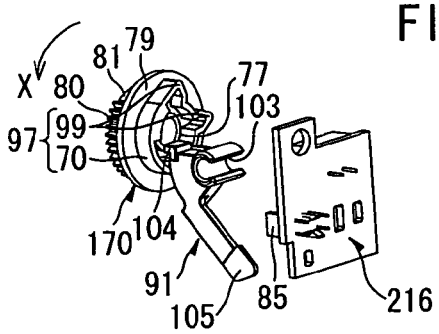
FIG. 14 (c-2)
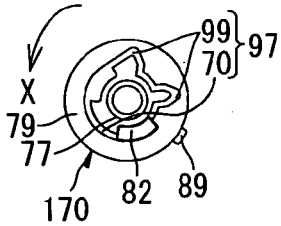
FIG. 15-1
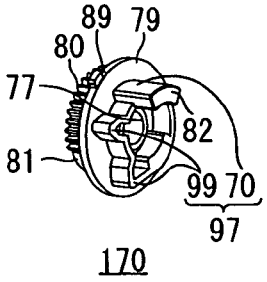
FIG. 15-2
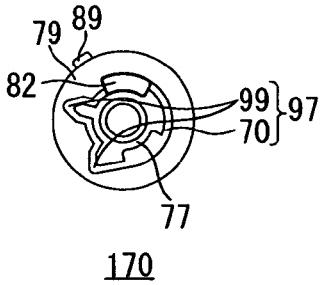

IMAGE FORMING APPARATUS, IMAGE FORMING UNIT AND DEVELOPER CARTRIDGE

CROSS REFERENCE TO RELATED APPLICATION

This application claims priority benefits on the basis of Japanese Patent Application No. 2005-229905 filed on Aug. 8, 2005, the disclosure of which is incorporated herein by reference.

BACKGROUND OF THE INVENTION

1. Field of the Invention

The present invention relates to an image forming apparatus (e.g., a laser printer), and to a developer cartridge to be removably mounted in the image forming apparatus.

2. Description of the Related Art

Conventionally, a developer cartridge which contains a toner is removably mounted in a laser printer. Such a laser printer includes new cartridge detection unit which judges whether or not the mounted developer cartridge is new and determines the service life of the new developer cartridge.

New cartridge detection unit proposed, for example, in Japanese Unexamined Patent Publication No. 2000-221781 includes a sector gear provided in a developer cartridge and having a projection and a recess. When the developer cartridge is newly mounted in an image forming apparatus body, the projection of the sector gear enters a new cartridge detection sensor to turn on the new cartridge detection sensor. When driving of an idler gear is started after the mounting of the developer cartridge, the sector gear is rotated to move the projection from the new cartridge detection sensor to a used cartridge detection sensor, whereby the projection enters the used cartridge detection sensor to turn on the used cartridge detection sensor. At the same time, the idler gear reaches the recess of the sector gear to stop the rotation of the sector gear.

Further, new cartridge detection unit proposed, for example, in Japanese Unexamined Patent Publication No. 2005-55544 and US Unexamined Patent Publication No. 2005031359 includes a third intermediate gear and a detection gear provided in a developer cartridge removably mounted in a laser printer, and an actuator provided in a main body frame of the laser printer. Power is inputted to the third intermediate gear. The detection gear has an abutment member, and is irreversibly moved from a new cartridge position at which the detection gear is not meshed with the third intermediate gear to a used cartridge position at which the detection gear is not meshed with the third intermediate gear through a power transmission position at which the detection gear is meshed with the third intermediate gear. The actuator is brought into abutment against the abutment member of the detection gear to move the detection gear from the new cartridge position to the power transmission position when the developer cartridge is mounted.

SUMMARY OF THE INVENTION

In the new cartridge detection unit disclosed in Japanese Unexamined Patent Publication No. 2000-221781, the projection enters the new cartridge detection sensor when the new cartridge is detected, and the projection enters the used cartridge detection sensor when a used cartridge is detected. Therefore, this arrangement requires the new cartridge detection sensor and the used cartridge detection sensor, resulting in increased costs and complicated construction.

There is a demand from some users to provide plural types of developer cartridges containing different amounts of toner in a variety of price ranges to select an optimum one of the plural types of developer cartridges in consideration of the frequency of use and costs when the developer cartridge is replaced.

Where the plural types of developer cartridges having different toner amounts are provided to meet the demand, a toner agitation state and a toner deterioration speed vary depending on the amount of the toner contained in the developer cartridge.

In this case, even if the new developer cartridge is detected, the service life of the detected new developer cartridge varies depending on the amount of the toner contained in the new cartridge. Therefore, the service life of the developer cartridge cannot be accurately determined. In the case of a developer cartridge containing a smaller amount of toner, for example, the end of the service life of the cartridge cannot be detected even if the cartridge actually reaches the end of the service life. This results in deterioration of image quality.

In the new cartridge detection unit disclosed in Japanese Unexamined Patent Publication No. 2005-55544 and US Unexamined Patent Publication No. 2005031359, the actuator of the main body frame is brought into abutment against the abutment member provided in the developer cartridge for detection of the new cartridge. Therefore, the developer cartridge should be disposed in the vicinity of an image forming apparatus body. Accordingly even if it is permissible to locate the developer cartridge in spaced relation from the image forming apparatus body, a space between the developer cartridge and the image forming apparatus body should be eliminated to locate the developer cartridge in the vicinity of the main body frame by increasing the size of the developer cartridge. This significantly hinders the size reduction of the image forming apparatus including the developer cartridge.

It is an object of the present invention to provide an image forming apparatus which is capable of judging information on a developer cartridge without increase in costs and complication in construction and is designed so that the developer cartridge can be spaced from an image forming apparatus body without the need for size increase of the developer cartridge i.e., with a higher design flexibility, and to provide an image forming unit and a developer cartridge to be removably mounted in the image forming apparatus.

According to one aspect of the present invention, there is provided an image forming apparatus, which comprises an image forming apparatus body, a photosensitive unit removably mounted in the image forming apparatus body and having an image carrier, a developer cartridge which contains developer, the developer cartridge being removably mounted in the photosensitive unit and having a developer carrier, a driving unit provided in the image forming apparatus body, a drive member provided in the developer cartridge and permitted to be driven by the driving unit when the developer cartridge is mounted in the image forming apparatus body, consequently driven by a predetermined driving amount from start of the driving to end of the driving, a movement member which is movable with the driving of the drive member, a transmission member provided in the photosensitive unit and moved by abutment of the movement member against the transmission member, a detection unit provided in the image forming apparatus body for detecting the movement of the transmission member, and a information judging unit which judges information on the developer cartridge on the basis of a result of the detection by the detection unit.

According to another aspect of the present invention, there is provided an image forming unit, which comprises a photosensitive unit removably mounted in an image forming apparatus body and having an image carrier, and a developer cartridge which contains developer, the developer cartridge being removably mounted in the photosensitive unit and having a developer carrier, wherein the developer cartridge includes a drive member permitted to be driven by a driving unit provided in the image forming apparatus body when the developer cartridge is mounted in the image forming apparatus body, consequently driven by a predetermined driving amount from start of the driving to end of the driving, and a movement member which is movable with the driving of the drive member to be brought into abutment against a transmission member provided in the photosensitive unit to move the transmission member so that the movement of the transmission member is detected by a detection unit provided in the image forming apparatus body.

According to further another aspect of the present invention, there is provided a developer cartridge which contains developer and has a developer carrier, removably mounted in a photosensitive unit which is removably mounted in an image forming apparatus body and has an image carrier, the developer cartridge comprising a drive member permitted to be driven by a driving unit provided in the image forming apparatus body when the developer cartridge is mounted in the image forming apparatus body, consequently driven by a predetermined driving amount from start of the driving to end of the driving, and a movement member which is movable with the driving of the drive member to be brought into abutment against a transmission member provided in the photosensitive unit to move the transmission member so that the movement of the transmission member is detected by a detection unit provided in the image forming apparatus body.

BRIEF DESCRIPTION OF THE DRAWINGS

FIGS. 13-1 and 13-2 are a perspective view and a side view, respectively, of the detection gear having the single abutment projection as seen from the abutment projection side;

FIGS. 14(*a*-1), 14(*b*-1) and 14(*c*-1), and FIGS. 14(*a*-2), 14(*b*-2) and 14(*c*-2) are perspective views and side views of the detection gear as seen from the abutment projection side, respectively, for explaining the operation of a new cartridge detection mechanism (having a wide abutment projection), particularly, FIGS. 14(*a*-1) and 14(*a*-2) illustrating a state with the abutment projection in abutment against the lever, FIGS. 14(*b*-1) and 14(*b*-2) illustrating a state with the abutment projection passing over the lever, and FIGS. 14(*c*-1) and 14(*c*-2) illustrating a state after the abutment projection passes over the lever; and FIGS. 15-1 and 15-2 are a perspective view and a side view, respectively, of a detection gear having the wide abutment projection as seen from the abutment projection side.

DETAILED DESCRIPTION OF PREFERRED EMBODIMENTS

Embodiments of the present invention will hereinafter be described with reference to the attached drawings.

First Embodiment

1. Overall Construction of Color Laser Printer

Figure 1:
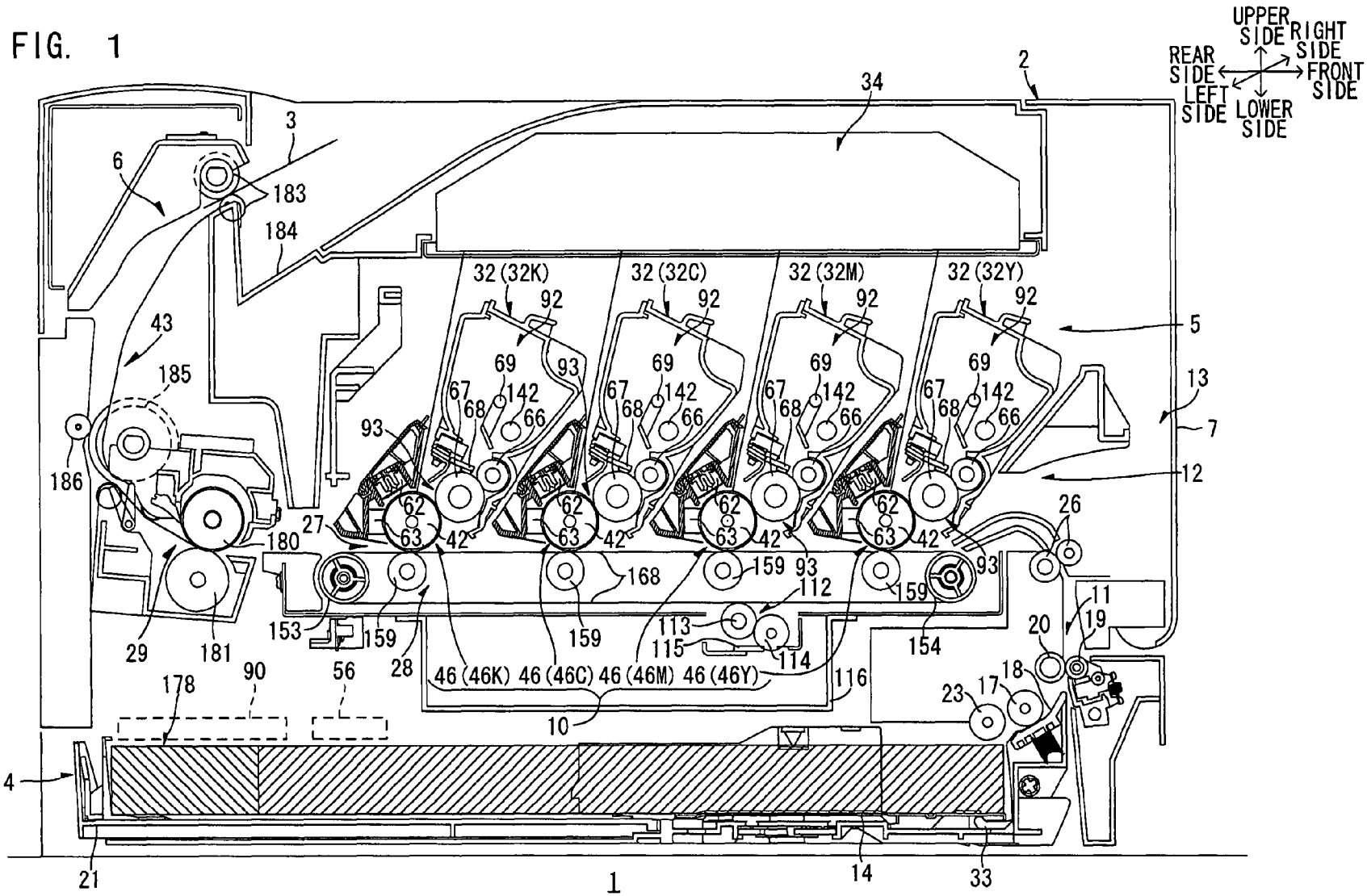
FIG. 1 is a sectional side elevation illustrating a major portion of a color laser printer as an image forming apparatus according to one embodiment of the present invention.
Figure 2:
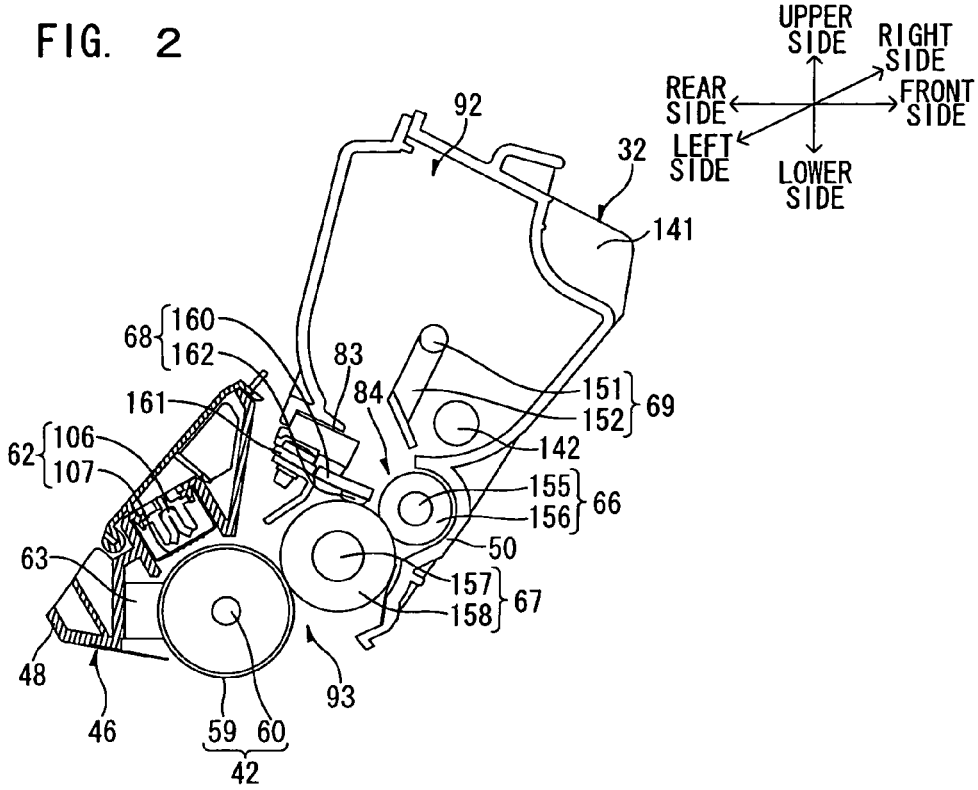
FIG. 2 is a sectional side elevation of a major portion of a drum subunit of the color laser printer of FIG. 1 in which a developer cartridge is mounted.
Figure 3:
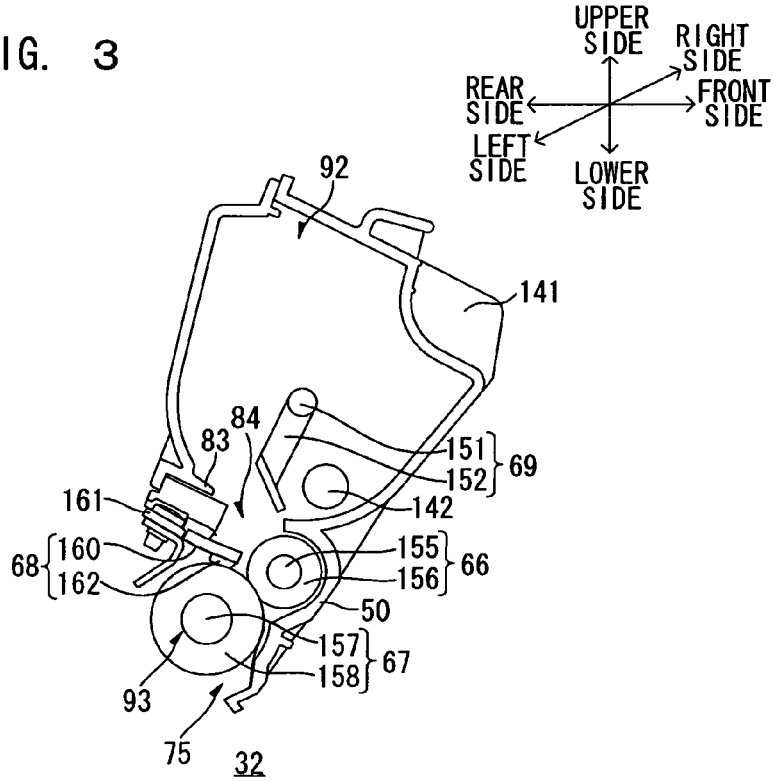
FIG. 3 is a sectional side elevation of a major portion of the developer cartridge shown in FIG. 2.
Figure 4:
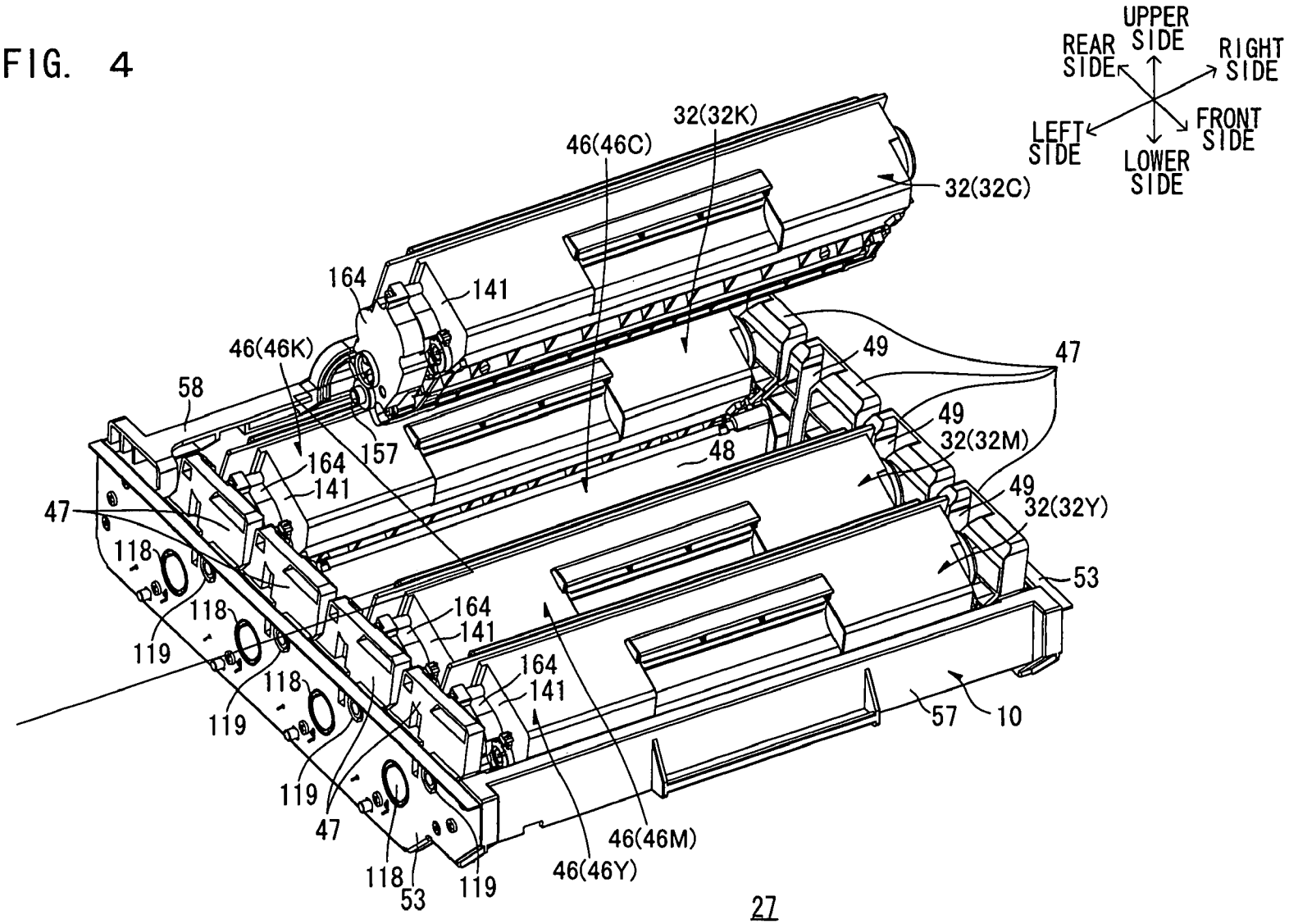
FIG. 4 is a left perspective view of a drum unit (with one developer cartridge being detached)

FIG. 1 is a sectional side elevation illustrating a major portion of a color laser printer as an image forming apparatus according to one embodiment of the present invention, and FIG. 2 is a sectional side elevation of a major portion of a drum subunit of the color laser printer of FIG. 1 in which a developer cartridge is mounted. FIG. 3 is a sectional side elevation of a major portion of the developer cartridge shown in FIG. 2, and FIG. 4 is a left perspective view of a processing section of the color laser printer of FIG. 1.

In FIG. 1, the color laser printer 1 is a tandem color laser printer of a horizontal type, in which a plurality of drum subunits 46 are horizontally arranged in tandem. The color laser printer 1 includes a sheet feeding section 4 for feeding a sheet 3 (recording medium), an image forming section 5 for forming an image on the fed sheet 3, and a sheet ejecting section 6 for ejecting the sheet 3 formed with the image, which are provided in a main body casing 2 (image forming apparatus body) of the printer.

In the following description, a right side of the paper surface of FIG. 1 (a side of the main body casing 2 provided with a drum mounting port 13) and a left side of the paper surface of FIG. 1 are respectively defined as front and rear sides of the color laser printer 1. Front and rear sides of the paper sheet of FIG. 1 with respect to the thickness of the paper sheet are respectively defined as left and right sides of the color laser printer 1.

In the following description, directions are defined on the assumption that a drum unit 10 and developer cartridges 32 are mounted in the main body casing 2, unless otherwise specified.

(1) Main Body Casing

The main body casing 2 has a generally rectangular box shape as seen in elevation, and has a front opening. In the main body casing 2, a processing section accommodating section 12 which accommodates a processing section 27 to be described later is formed. A front cover 7 is provided on a front wall of the main body casing 2. The front cover 7 is supported rotationally about a hinge (not shown) provided on a lower edge of the front wall of the main body casing 2 so as to be opened and closed with respect to the main body casing 2. When the front cover 7 is rotated about the hinge to be closed, the processing section accommodating section 12 is closed by the front cover 7. When the front cover is rotated about the hinge to be opened, the processing section accommodating section 12 is opened, so that the processing section 27 can be mounted and demounted with respect to the processing section accommodating section 12 from the front side.

In the main body casing 2, a tray accommodating section 178 is further formed below the processing section accommodating section 12 for accommodating a sheet feeding tray 21 to be described later. The sheet feeding tray 21 is mounted in the tray accommodating section 178 in an anteroposteriorly slidable manner.

(2) Sheet Feeding Section

The sheet feeding section 4 is provided in a bottom portion of the main body casing 2, and includes the sheet feeding tray 21 which contains sheets 3 and is mounted and demounted with respect to the tray accommodating section 178 of the main body casing 2 in an anteroposteriorly slidable manner from the front side, a separation roller 17 and a separation pad 18 provided in opposed relation above a front edge of the sheet feeding tray 21, and a sheet feeding roller 23 provided on the rear side of the separation roller 17.

In the sheet feeding section 4, a sheet feeding transport path 11 for feeding the sheet 3 has an upstream end located adjacent the separation roller 17 on a lower side, and a downstream end located adjacent a conveyor belt 168 to be described later on an upper side. The sheet feeding transport path 11 has a generally U-shape as seen in elevation, so that the sheet 3 is fed forward, then reversed, and fed out of the sheet feeding transport path 11 toward the rear side.

In the sheet feeding transport path 11, a paper dust removing roller 19 and a pinch roller 20 are disposed in opposed relation above the front side of the separation roller 17, and a pair of registration rollers 26 are disposed above the paper dust removing roller 19 and the pinch roller 20.

A sheet pressing plate 14 on which the sheets 3 are stacked is provided in the sheet feeding tray 21. The sheet pressing plate 14 is supported swingably about a rear edge thereof so as to be moved between a rest position at which the sheet pressing plate 14 fits on a bottom plate of the sheet feeding tray 21 with a front edge thereof being located on a lower side and a sheet feeding position at which the sheet pressing plate 14 is tilted with the front edge thereof being located on an upper side.

A sheet feeding lever 33 which lifts the front edge of the sheet pressing plate 14 is provided below the front edge of the sheet feeding tray 21. The sheet feeding lever 33 is supported in a vertically swingable manner below the front edge of the sheet pressing plate 14.

By swinging the sheet feeding lever 33, the front edge of the sheet pressing plate 14 is lifted by the sheet feeding lever 33, whereby the sheet pressing plate 14 is located at the sheet feeding position.

With the sheet pressing plate 14 being located at the sheet feeding position, the uppermost one of the sheets 3 on the sheet pressing plate 14 is pressed against the sheet feeding roller 23, and fed between the separation roller 17 and the separation pad 18 by the rotation of the sheet feeding roller 23.

When the sheet feeding tray 21 is taken out from the main body casing 2, the sheet pressing plate 14 is located at the rest position. With the sheet pressing plate 14 being located at the rest position, the sheets 3 can be rested on the sheet pressing plate 14 in a stacked state.

The fed sheet 3 is held between the separation roller 17 and the separation pad 18 by the rotation of the separation roller 17 thereby to be separated from the other sheets 3 and transported. The transported sheet 3 is passed between the paper dust removing roller 19 and the pinch roller 20 and, after removal of paper dust, transported along the sheet feeding transport path 11 toward the registration rollers 26.

The registration rollers 26 transport the sheet 3 onto the conveyor belt 168 after registration.

(3) Image Forming Section

The image forming section 5 includes a scanner section 34, the processing section 27, a transfer section 28 and a fixation section 29.

(3-1) Scanner Section

The single scanner section 34 is provided in an upper portion of the main body casing 2. Though not shown, the scanner section 34 includes a laser emitting section, a polygonal mirror, a plurality of lenses and a reflection mirror. In the scanner section 34, laser beams emitted from the laser emitting section are scanned on the basis of color image data corresponding to respective colors by the polygonal mirror, then passed through the plurality of lenses and reflected by the reflection mirror, and outputted toward photosensitive drums 42 for respective colors.

(3-2) Processing Section

The processing section 27 is disposed below the scanner section 34 and above the sheet feeding section 4. As shown in FIG. 4, the processing section 27 includes a single drum unit 10 and four developer cartridges 32 for the respective colors.

(3-2-1) Drum Unit

The drum unit 10 is mounted in the processing section accommodating section 12 of the main body casing 2 from the front side in an anteroposteriorly demountable manner. The drum unit 10 includes four drum subunits 46 (photosensitive units) for the respective colors. That is, the drum subunits 46 include a yellow drum subunit 46Y, a magenta drum subunit 46M, a cyan drum subunit 46C and a black drum subunit 46K.

The drum subunits 46 are arranged in tandem in anteroposteriorly spaced relation. More specifically, the yellow drum subunit 46Y, the magenta drum subunit 46M, the cyan drum subunit 46C and the black drum subunit 46K are arranged in this order from the front side to the rear side.

In the drum unit 10, the drum subunits 46 are anteroposteriorly arranged in tandem as described above, and a front beam 57 and a rear beam 58 are respectively provided on a front side of the foremost drum subunit 46 and on a rear side of the rearmost drum subunit 46. The front beam 57, the respective subunits 46 and the rear beam 58 are supported from laterally opposite sides by a pair of side plates 53 to be assembled. It is noted that the widthwise direction is herein defined as a lateral direction perpendicular to an anteroposterior direction and a vertical direction.

As shown in FIG. 2, the drum subunits 46 each include a photosensitive drum 42 (image carrier), a scorotron charger 62 and a cleaning brush 63.

The photosensitive drum 42 is disposed laterally, and has a cylindrical shape. The photosensitive drum 42 includes a drum body 59 having a positively chargeable photosensitive layer of polycarbonate provided as the outermost surface layer and a drum shaft 60 disposed axially of the drum body 59.

The drum shaft 60 is supported in a relatively nonrotatable manner by side frames 47 (described later) of the drum subunit 46.

Rotation support members 55 (see FIG. 8) are fitted in axially opposite end portions of the drum body 59 in a relatively nonrotatable manner, and supported around the drum shaft 60 in a relatively rotatable manner. Thus, the drum body 59 is supported rotatably about the drum shaft 60. In image formation, a driving force from a motor 56 (driving unit) provided in the main body casing 2 is transmitted to the photosensitive drum 42, thereby the photosensitive drum 42 is rotated.

The scorotron charger 62 is disposed obliquely rearward above the photosensitive drum 42 in opposed spaced relation to the photosensitive drum 42 and supported by a center frame 48 (described later) of the drum subunit 46. The scorotron charger 62 includes an electric discharge wire 106 disposed in opposed spaced relation to the photosensitive drum 42 and a grid 107 disposed between the electric discharge wire 106 and the photosensitive drum 42.

In the scorotron charger 62, a high voltage is applied to the electric discharge wire 106 from a high voltage board (not shown) provided in the main body casing 2 to cause the electric discharge wire 106 to generate corona discharge in the image formation. Further, a grid bias is applied to the grid 107 from the high voltage board to control the amount of electric charges supplied to the photosensitive drum 42, thereby uniformly positively charging the surface of the photosensitive drum 42.

The cleaning brush 63 is disposed on the rear side of the photosensitive drum 42 in contact with the photosensitive drum 42 and supported by the center frame 48 of the drum subunit 46. A cleaning bias is applied to the cleaning brush 63 from the high voltage board in the image formation.

(3-2-2) Developer Cartridges

The developer cartridges 32 are removably provided in association with the drum subunits 46 for the respective colors as shown in FIG. 4. That is, the developer cartridges 32 include four developer cartridges of a yellow developer cartridge 32Y removably mounted in the yellow drum subunit 46Y, a magenta developer cartridge 32M removably mounted in the magenta drum subunit 46M, a cyan developer cartridge 32C removably mounted in the cyan drum subunit 46C and a black developer cartridge 32K removably mounted in the black drum subunit 46K.

As shown in FIG. 3, the developer cartridges 32 each include a developer frame 50, and an agitator 69, a supply roller 66, a developer roller 67 (developer carrier) and a layer thickness regulating blade 68 which are provided in the developer frame 50.

The developer frame 50 has a box shape having a bottom opening 75 provided in a bottom thereof, and is partitioned into a toner containing chamber 92 and a developing chamber 93 by a partition wall 83 provided in a vertically middle portion of the developer frame 50. The partition wall 83 has a communication port 84 which permits communication between the toner containing chamber 92 and the developing chamber 93.

The toner containing chambers 92 of the developer cartridges 32 respectively contain toners as developers for the respective colors. More specifically, a yellow toner, a magenta toner, a cyan toner and a black toner are respectively contained in the yellow developer cartridge 32Y, the magenta developer cartridge 32M, the cyan developer cartridge 32C and the black developer cartridge 32K.

Positively-chargeable nonmagnetic single-component polymer toners are used as the toners for the respective colors. The polymer toners are generally spherical particles. For preparation of the polymer toners, a binder resin prepared by copolymerizing a styrenic monomer such as styrene and an acrylic monomer such as acrylic acid, an alkyl (C1 to C4) acrylate or an alkyl (C1 to C4) methacrylate by a known polymerization method such as suspension polymerization is used as a principal component, and toner matrix particles are prepared by blending colorants for the respective colors, a charge controlling agent, a wax and the like with the binder resin. Further, an external additive is added to the toner matrix particles for improvement of the fluidity of the toners.

Yellow, magenta, cyan and black colorants are blended as the colorants for the respective color toners. A charge controlling resin prepared by copolymerization of an ionic monomer, which has ionic functional group, such as an ammonium salt and a monomer, which is copolymerizable with the ionic monomer, such as a styrenic monomer or an acrylic monomer is blended as the charge controlling agent. Examples of the external additive include metal oxide particles such as of silica, aluminum oxide, titanium oxide, strontium titanate, cerium oxide and magnesium oxide, and inorganic particles such as of carbides and metal salts.

The toner containing chamber 92 has windows 142 for detecting the amount of the toner remaining in the toner containing chamber 92. The windows 142 are respectively provided in opposite side walls 141 of the developer frame 50 so as to be located on opposite sides of the toner containing chamber 92 (see FIG. 5).

The agitator 69 is provided in the toner containing chamber 92. The agitator 69 includes a rotation shaft 151 rotatably supported by the opposite side walls 141 of the developer frame 50, and an agitating member 152 provided along the axis of the rotation shaft 151 as extending radially outward from the rotation shaft 151. In the image formation, the driving force from the motor 56 provided in the main body casing 2 is transmitted to the rotation shaft 151 via a coupling passive gear 165 (see FIG. 5), whereby the agitating member 152 is circumferentially moved in the toner containing chamber 92.

The supply roller 66 is disposed below the communication port 84 in the developing chamber 93. The supply roller 66 includes a supply roller shaft 155 of a metal rotatably supported by the opposite side walls 141 of the developer frame 50, and a sponge roller 156 of an electrically conductive sponge covering the supply roller shaft 155. In the image formation, the driving force from the motor 56 provided in the main body casing 2 is transmitted to the supply roller shaft 155 via the coupling passive gear 165 (see FIG. 5), whereby the supply roller 66 is rotated.

The developer roller 67 is provided obliquely rearward below the supply roller 66 in the developing chamber 93. The developer roller 67 includes a developer roller shaft 157 of a metal rotatably supported by the opposite side walls 141 of the developer frame 50, and a rubber roller 158 of an electrically conductive rubber covering the developer roller shaft 157.

More specifically, the rubber roller 158 is of a double layer structure including a rubber roller layer of an electrically conductive urethane rubber, an electrically conductive silicone rubber or an electrically conductive EPDM rubber containing carbon particles and the like, and a coating layer covering the surface of the rubber roller layer and prepared from a material essentially containing a urethane rubber, a urethane resin or a polyimide resin.

The developer roller 67 is disposed in association with the supply roller 66 so that the rubber roller 158 thereof is in press contact with the sponge roller 156 of the supply roller 66. A lower portion of the developer roller 67 is exposed from the bottom opening 75 of the developing chamber 93.

In the image formation, the driving force from the motor 56 provided in the main body casing 2 is transmitted to the developer roller shaft 157 of the developer roller 67 via the coupling passive gear 165 (see FIG. 5), whereby the developer roller 67 is rotated. Further, a developing bias is applied to the developer roller 67 from the high voltage board (not shown) provided in the main body casing 2.

The layer thickness regulating blade 68 is disposed in the developing chamber 93 so as to be kept in press contact with the developer roller 67 from the upper side. The layer thickness regulating blade 68 includes a blade 160 of a metal leaf spring, and a press member 162 of an electrically insulative silicone rubber having a semicircular cross section and provided on a distal edge of the blade 160.

A proximal edge of the blade 160 is fixed to the partition wall 83 by a fixture member 161. The press member 162 provided on the distal edge of the blade 160 is pressed against the rubber roller 158 of the developer roller 67 from the upper side by the resilient force of the blade 160.

(3-2-3) Developing Operation in Processing Section

In each of the developer cartridges 32, the color toner contained in the toner containing chamber 92 moves to the communication port 84 by its own weight, and is released from the communication port 84 into the developing chamber 93 while being agitated by the agitator 69.

The toner released from the communication port 84 into the developing chamber 93 is supplied to the supply roller 66. The toner supplied to the supply roller 66 is further supplied to the developer roller 67 by the rotation of the supply roller 66 and, at this time, is triboelectrically positively charged between the supply roller 66 and the developer roller 67 to which the developing bias is applied.

The toner supplied to the developer roller 67 is introduced between the press member 162 of the layer thickness regulating blade 68 and the rubber roller 158 of the developer roller 67 by the rotation of the developer roller 67, whereby the toner is carried in the form of a thin film having a uniform thickness on the surface of the rubber roller 158.

On the other hand, in the drum subunit 46 associated with the each developer cartridge 32, as shown in FIG. 2, the scorotron charger 62 causes corona discharge to uniformly positively charge the surface of the photosensitive drum 42.

The surface of the photosensitive drum 42, after being uniformly positively charged by the scorotron charger 62, as the rotation of the photosensitive drum 42, is exposed to the laser beams scanned at a high speed by the scanner section 34, whereby an electrostatic latent image for an image to be formed on the sheet 3 is formed on the surface of the photosensitive drum 42.

As the photosensitive drum 42 is rotated, the toner positively charged and carried on the surface of the developer roller 67 is brought into contact with the photosensitive drum 42 by the rotation of the developer roller 67. At this time, the toner is supplied to the electrostatic latent image formed on the surface of the photosensitive drum 42, i.e., to an exposed part of the surface of the uniformly positively charged photosensitive drum 42 having a potential reduced by the exposure with the laser beams. Thus, the electrostatic latent image on the photosensitive drum 42 is developed into a visible form, whereby a color toner image is carried on the surface of the photosensitive drum 42 by reversion.

The toner remaining on the photosensitive drum 42 after the toner image is transferred is recovered by the developer roller 67. Paper dust generated from the sheet 3 and adhering to the photosensitive drum 42 after the transfer is removed by the cleaning brush 63.

(3-3) Transfer Section

As shown in FIG. 1, the transfer section 28 is disposed anteroposteriorly above the sheet feeding section 4 and below the drum unit 10 in the main body casing 2. The transfer section 28 includes a driving roller 153, a driven roller 154, the conveyor belt 168, transfer rollers 159 and a cleaning section 112.

The driving roller 153 and the driven roller 154 are disposed in anteroposteriorly opposed spaced relation. The driving roller 153 is located on the rear side of the black drum subunit 46K, and the driven roller 154 is located on the front side of the yellow drum subunit 46Y.

The conveyor belt 168 is an endless belt formed of an electrically conductive resin film such as of polycarbonate or polyimide containing electrically conductive particles such as carbon powder dispersed therein. The conveyor belt 168 is wound between the driving roller 153 and the driven roller 154.

In the image formation, the driving force from the motor 56 provided in the main body casing 2 is transmitted to the driving roller 153 to rotate the driving roller 153. Then, the conveyor belt 168 is circulated between the driving roller 153 and the driven roller 154 so as to be rotated in the same direction as the photosensitive drums 42 at transfer positions at which the conveyor belt 168 contacts the photosensitive drums 42 of the respective drum subunits 46 in opposed relation, whereby the driven roller 154 is driven.

The transfer rollers 159 are disposed in a space defined by the transfer belt 168 wound between the driving roller 153 and the driven roller 154 so as to be respectively opposed to the photosensitive drums 42 with the intervention of the conveyor belt 168. The transfer rollers 159 each include a metal roller shaft and a rubber roller of an electrically conductive rubber covering the roller shaft. The transfer rollers 159 are rotated in the same direction as the circulation direction of the conveyor belt 168 at the transfer positions at which the transfer rollers 159 contact the conveyor belt 168 in opposed relation. In the image formation, a transfer bias from the high voltage board (not shown) provided in the main body casing 2 is applied to the transfer rollers 159.

The cleaning section 112 is disposed below the conveyor belt 168 wound between the driving roller 153 and the driven roller 154, and includes a primary cleaning roller 113, a secondary cleaning roller 114, a scraping blade 115 and a toner storing portion 116.

The primary cleaning roller 113 is disposed in contact with a lower portion of the conveyor belt 168 opposite from an upper portion of the conveyor belt 168 which contacts the photosensitive drums 42 and the transfer rollers 159. The primary cleaning roller 113 is rotated in the same direction as the circulation direction of the conveyor belt 168 at a position of the contact. In the image formation, a primary cleaning bias from the high voltage board (not shown) provided in the main body casing 2 is applied to the primary cleaning roller 113.

The secondary cleaning roller 114 contacts the primary cleaning roller 113 from the lower side, and is rotated in the same direction as the rotation direction of the primary cleaning roller 113 at a position of the contact. In the image formation, a secondary cleaning bias from the high voltage board (not shown) provided in the main body casing 2 is applied to the secondary cleaning roller 114.

The scraping blade 115 contacts the secondary cleaning roller 114 from the lower side.

The toner storing portion 116 is disposed below the primary cleaning roller 113 and the secondary cleaning roller 114 so as to store toner falling from the secondary cleaning roller 114.

The sheet 3 fed from the sheet feeding section 4 is transported from the front side to the rear side by the conveyor belt 168 circulated by the active driving of the driving roller 153 and the passive driving of the driven roller 154 so as to be passed sequentially through the transfer positions associated with the respective drum subunits 46. During the transportation of the sheet 3, the toner images carried on the photosensitive drums 42 of the respective drum subunits 46 are sequentially transferred onto the sheet 3, whereby a color image is formed on the sheet 3.

That is, a yellow toner image carried on the surface of the photosensitive drum 42 of the yellow drum subunit 46Y is first transferred onto the sheet 3, and then a magenta toner image carried on the surface of the photosensitive drum 42 of the magenta drum subunit 46M is transferred onto the sheet 3 to be superposed on the yellow toner image on the sheet 3. In the same manner, a cyan toner image carried on the surface of the photosensitive drum 42 of the cyan drum subunit 46C and a black toner image carried on the surface of the photosensitive drum 42 of the black drum subunit 46K are transferred in superposed relation onto the sheet 3, whereby the color image is formed on the sheet 3.

In the aforementioned transfer operation, the toners adhering to the surface of the conveyor belt 168 are first transferred from the surface of the conveyor belt 168 to the primary cleaning roller 113 by the primary cleaning bias, and further transferred to the secondary cleaning roller 114 by the secondary cleaning bias in the cleaning section 112. Thereafter, the toners transferred to the secondary cleaning roller 114 are scraped by the scraping blade 115, thereby falling from the secondary cleaning roller 114 to be stored in the toner storing portion 116.

(3-4) Fixation Section

The fixation section 29 is disposed on the rear side of the black drum subunit 46K in anteroposteriorly opposed relation to the transfer position at which the photosensitive drum 42 of the black drum subunit 46K contacts the conveyor belt 168 in the main body casing 2. The fixation section 29 includes a heat roller 180 and a press roller 181.

The heat roller 180 includes a metal pipe, a release layer provided on the surface of the metal pipe, and a halogen lamp disposed in the metal pipe axially of the metal pipe. The surface of the heat roller 180 is heated at a fixation temperature by the halogen lamp.

The press roller 181 is disposed in opposed relation to the heat roller 180 below the heat roller 180. The press roller 181 presses the heat roller 180 from the lower side.

The sheet 3 formed with the color image by the transfer of the toner images is transported to the fixation section 29, and the color image is thermally fixed on the sheet 3 as the sheet 3 is passed between the heat roller 180 and the press roller 181.

(4) Sheet Ejecting Section

In the sheet ejecting section 6, a sheet ejecting transport path 43 for ejecting the sheet 3 has an upstream end located adjacent the fixation section 29 on a lower side, and a downstream end located adjacent a sheet ejection tray 184 on an upper side. The sheet ejecting transport path 43 has a generally U-shape as seen in elevation, so that the sheet 3 is transported rearward, then reversed, and ejected toward the front side.

In the sheet ejecting transport path 43, a transport roller 185 and a pinch roller 186 are provided in opposed relation. A pair of sheet ejection rollers 183 are provided at the downstream end of the sheet ejecting transport path 43.

The sheet ejection tray 184 is disposed in the sheet ejecting section 6. The sheet ejection tray 184 is formed such that an upper wall of the main body casing 2 is recessed gradually from the front side to the rear side for receiving ejected sheets 3 in stacked relation.

The sheet 3 transported from the fixation section 29 is further transported along the sheet ejecting transport path 43 by the transport roller 185 and the pinch roller 186, and ejected onto the sheet ejection tray 184 by the sheet ejection rollers 183.

2. Arrangement for Detecting New Developer Cartridge

Figure 5:
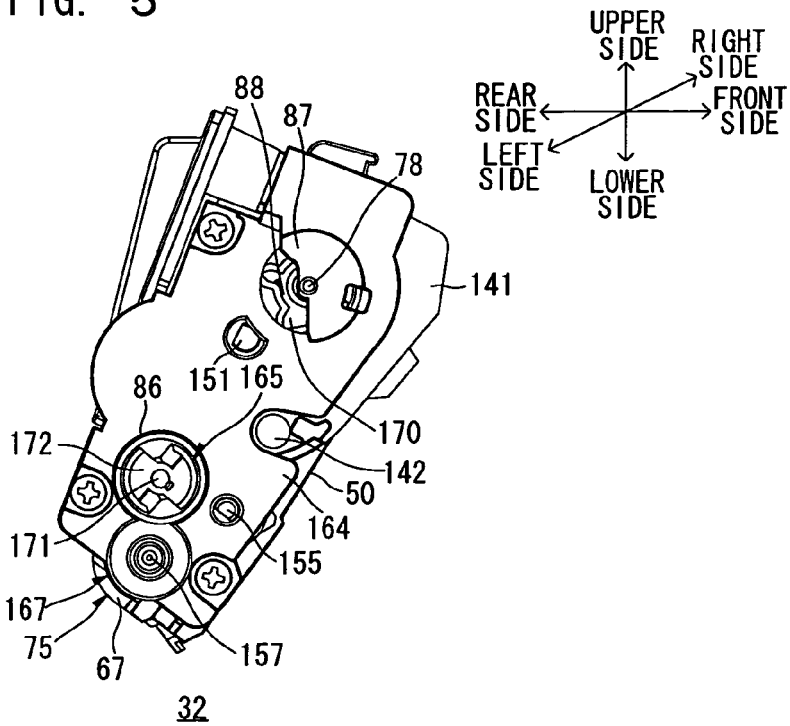
FIG. 5 is a left side view of the developer cartridge (with a gear cover being attached)
Figure 6:
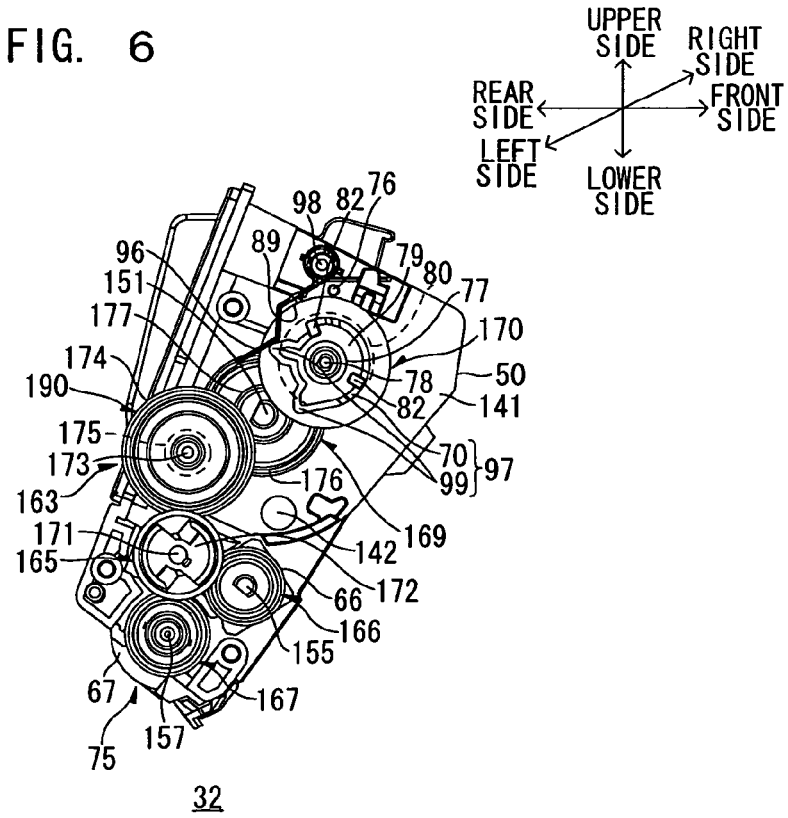
FIG. 6 is a left side view of the developer cartridge (with the gear cover being detached)
Figure 7:
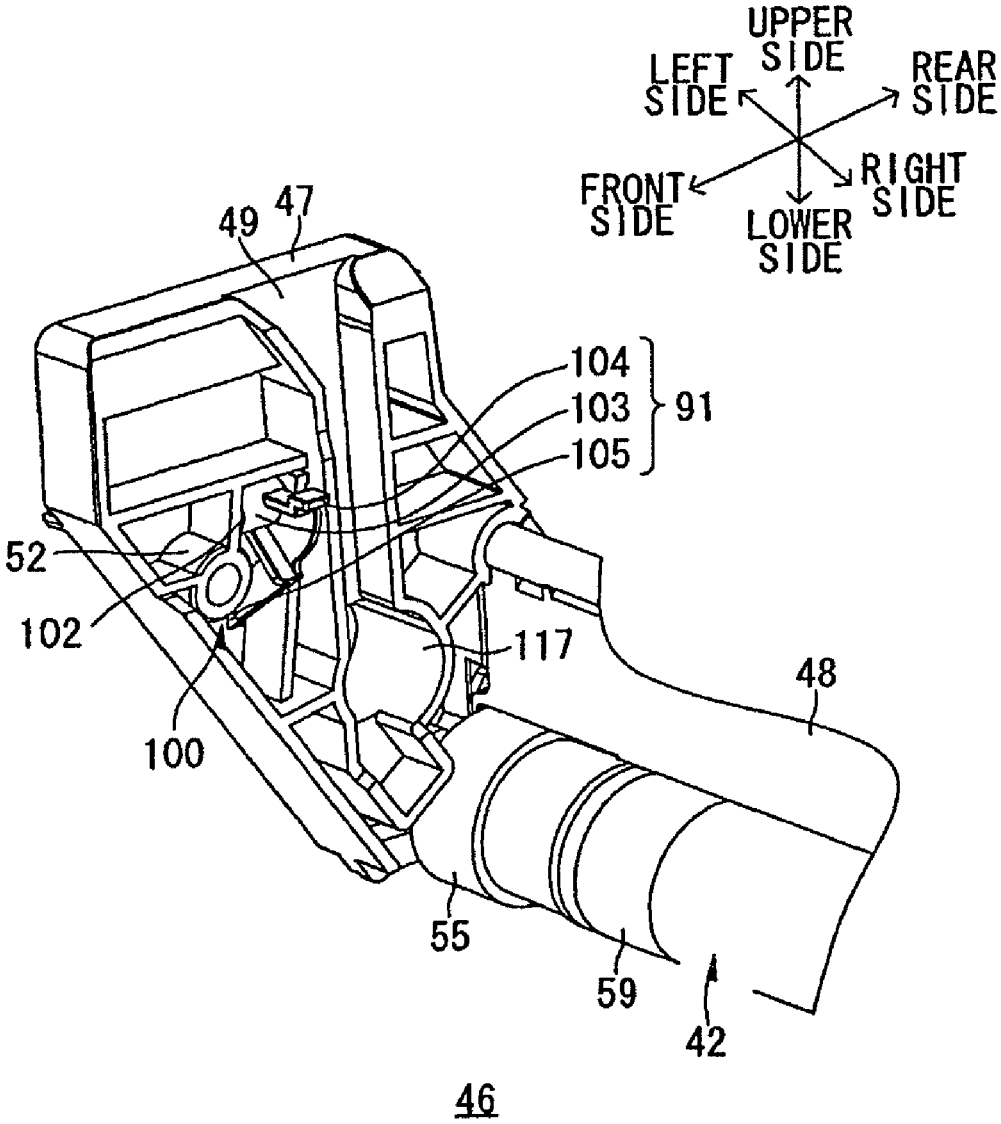
FIG. 7 is an enlarged right perspective view of a major portion of the drum subunit.
Figure 8:
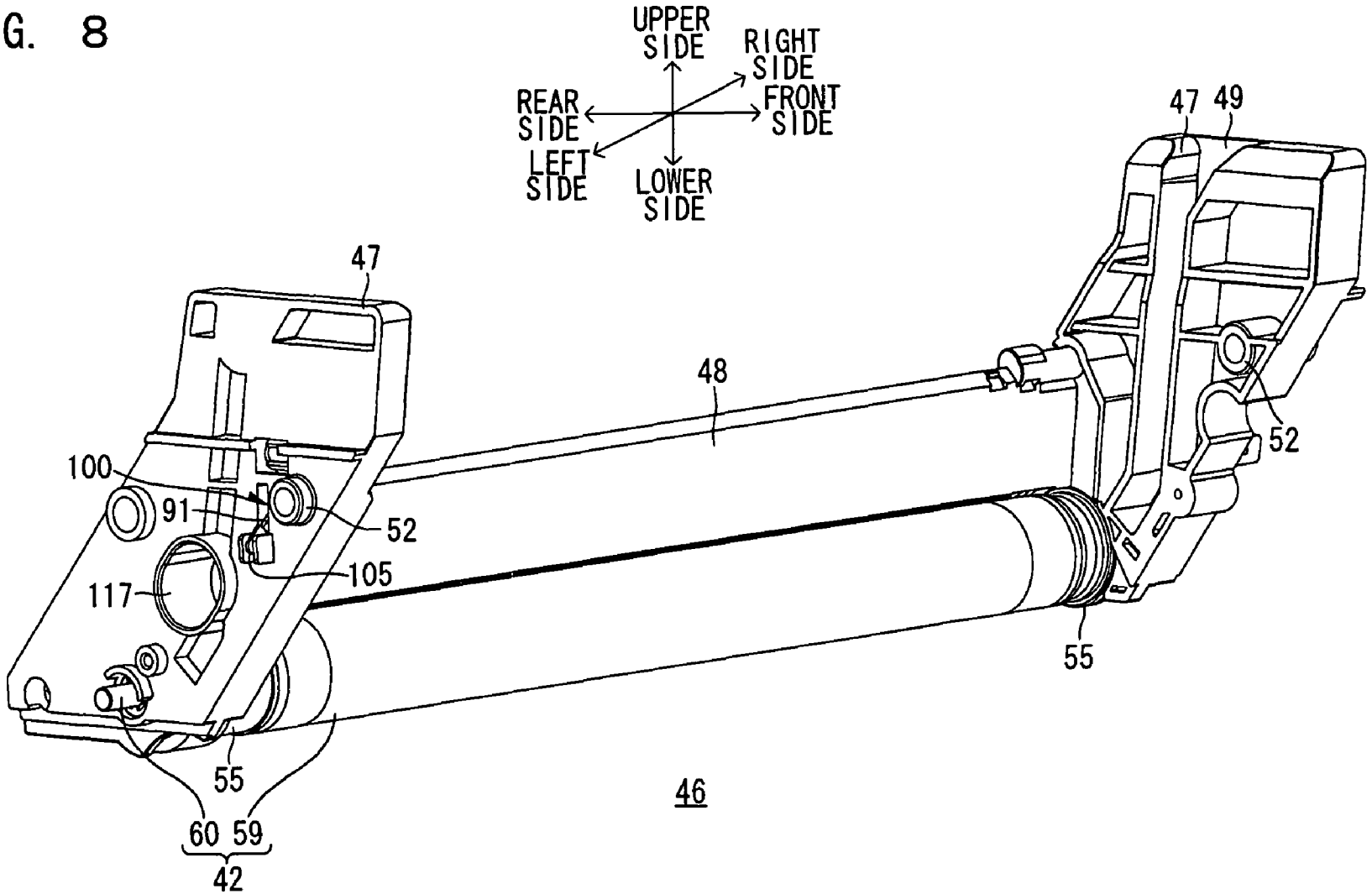
FIG. 8 is a left perspective view of the drum subunit.
Figure 9:
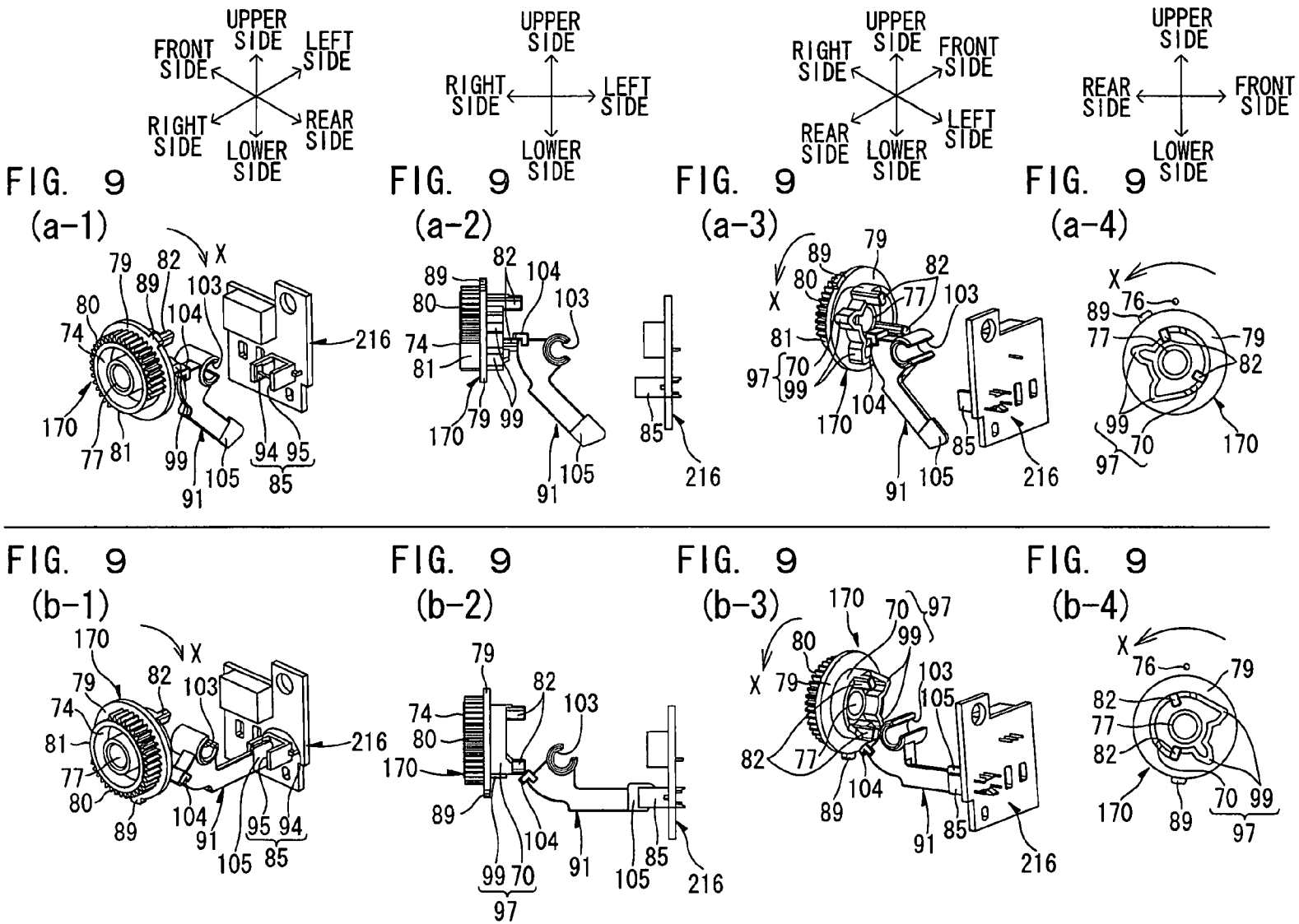
FIGS. 9(*a*-1) and 9(*b*-1), FIGS. 9(*a*-2) and 9(*b*-2), FIGS. 9(*a*-3) and 9(*b*-3), and FIGS. 9(*a*-4) and 9(*b*-4) are perspective views as seen from a toothed portion side, rear views, perspective views as seen from an abutment projection side and side views of a detection gear, respectively, for explaining the operation of a new cartridge detection mechanism (having two abutment projections), particularly, FIGS. 9(*a*-1) to 9(*a*-4) illustrating a state before the developer cartridge is mounted in a main body casing, and FIGS. 9(*b*-1) to 9(*b*-4) illustrating a state with a leading abutment projection in abutment against a lever after the developer cartridge is mounted in the main body casing.
Figure 12:
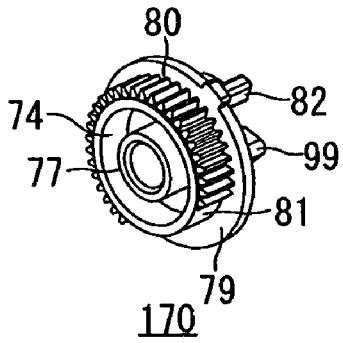
FIGS. 12(*a*-1) and 12(*a*-2), and FIGS. 12(*b*-1) and 12(*b*-2) are a perspective view and a side view as seen from the toothed portion side, and a perspective view and a side view as seen from the abutment projection side, respectively, illustrating the detection gear having the two abutment projections.
Figure 12:
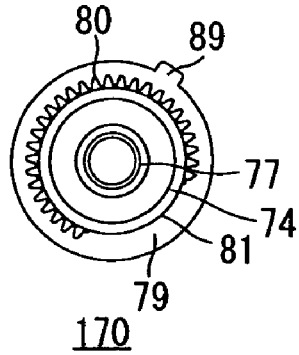
Figure 12:
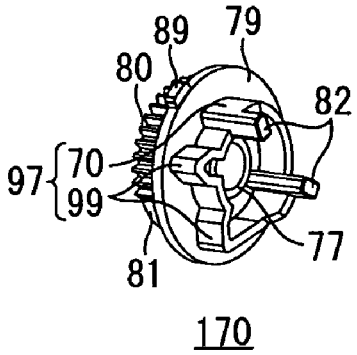
Figure 12:
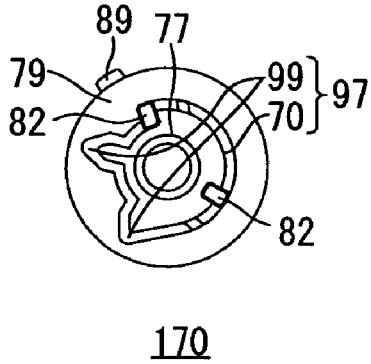
Figures 1, 13:
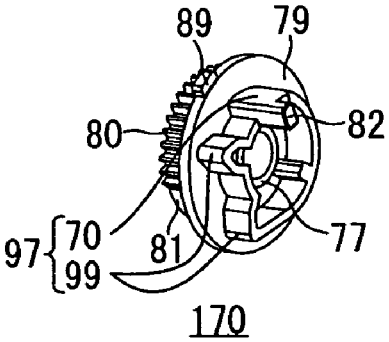
Figures 2, 13:
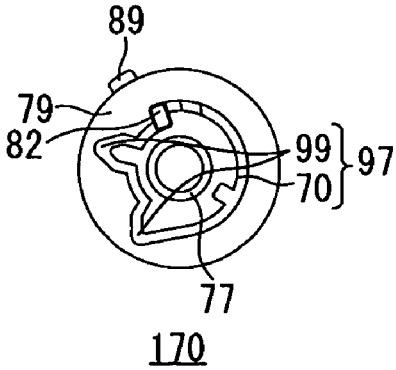

FIG. 5 is a left side view of the developer cartridge (with a gear cover being attached), and FIG. 6 is a left side view of the developer cartridge (with the gear cover being detached). FIG. 7 is an enlarged right perspective view of a major portion of the drum subunit, and FIG. 8 is a left perspective view of the drum subunit. FIGS. 9(*a*-1) to 9(*b*-4), FIGS. 10(*c*-1) to 10(*e*-4) are diagrams for explaining the operation of a new cartridge detection mechanism (having two abutment projections), and FIGS. 11(*a*-1) to 11(*c*-4) are diagrams for explaining the operation of a new cartridge detection mechanism (having a single abutment projection). FIGS. 12(*a*-1) and 12(*a*-2), and FIGS. 12(*b*-1) and 12(*b*-2) are a perspective view and a side view as seen from a toothed portion side, and a perspective view and a side view as seen from an abutment projection side, respectively, illustrating a detection gear having the two abutment projections. FIGS. 13-1 and 13-2 are a perspective view and a side view, respectively, of a detection gear having the single abutment projection as seen from the abutment projection side.

(1) Construction of Developer Cartridge

As described above, the rotation shaft 151 of the agitator 69, the supply roller shaft 155 of the supply roller 66 and a gear mechanism 163 for rotatively driving the developer roller shaft 157 of the developer roller 67 are provided in the developer cartridge 32 as shown in FIG. 6. Further, the developer cartridge 32 includes a gear cover 164 which covers the gear mechanism 163 as shown in FIG. 5.

As shown in FIG. 6, the gear mechanism 163 is disposed on a left side wall 141 of the developer frame 50 of the developer cartridge 32. The gear mechanism 163 includes the coupling passive gear 165, a supply roller driving gear 166, a developer roller driving gear 167, an intermediate gear 190, an agitator driving gear 169 and a detection gear 170 (drive member).

The coupling passive gear 165 is supported rotatably about an input gear support shaft 171 projecting laterally outward (to the left side) from the left side wall 141 between the developer roller shaft 157 and the rotation shaft 151. A coupling receiving portion 172 to which the driving force from the motor 56 is inputted with the developer cartridge 32 being mounted in the main body casing 2 is provided around a shaft of the coupling passive gear 165.

The supply roller driving gear 166 is provided at an end of the supply roller shaft 155 in a relatively nonrotatable manner in mesh-engagement with the coupling passive gear 165 on the front side of the coupling passive gear 165.

The developer roller driving gear 167 is provided at an end of the developer shaft 157 in a relatively nonrotatable manner in mesh-engagement with the coupling passive gear 165 below the coupling passive gear 165.

The intermediate gear 190 is supported rotatably about an intermediate gear support shaft 173 projecting laterally outward (to the left side) from the left side wall 141 above the coupling passive gear 165. The intermediate gear 190 is a unitary two-step gear including intermediate gear outer teeth 174 meshed with the coupling passive gear 165 and intermediate gear inner teeth 175 meshed with the agitator driving gear 169.

The agitator driving gear 169 is provided at an end of the rotation shaft 151 in a relatively nonrotatable manner obliquely forward above the intermediate gear 190. The agitator driving gear 169 is a unitary two-step gear including agitator gear inner teeth 176 meshed with the intermediate gear inner teeth 175 of the intermediate gear 190 and agitator gear outer teeth 177 meshed with the detection gear 170.

The detection gear 170 is supported rotatably about a detection gear support shaft 78 projecting laterally outward from the left side wall 141 obliquely forward above the coupling passive gear 165.

The detection gear 170 is a partly toothed gear including a detection gear body 79, a toothed portion 80 (see FIGS. 12(*a*-1) to 12(*b*-2)), a non-toothed portion 81 (see FIGS. 12(*a*-1) to 12(*b*-2)) and abutment projections 82 (movement member), which are integrally formed. The toothed portion 80 and the non-toothed portion 81 of the detection gear 170 are opposed to an outer surface of the left side wall 141.

The detection gear body 79 is of a disk shape, and has a hollow cylindrical insertion portion 77 provided at the center thereof for receiving the detection gear support shaft 78 inserted therein in a relatively rotatable manner. The toothed portion 80 and the non-toothed portion 81 are provided on a right surface of the disk-shaped detection gear body 79, and the abutment projections 82 are provided on a left surface of the disk-shaped detection gear body 79. A rotation restricting claw 89 is provided on an outer peripheral portion of the detection gear body 79 as projecting radially outward of the detection gear body 79.

As shown in FIGS. 12(*a*-1) to 12(*b*-2), the toothed portion 80 and the non-toothed portion 81 constitute a cylindrical portion 74 which projects laterally inward (to the right side) from the right surface of the disk-shaped detection gear body 79. The cylindrical portion 74 is disposed concentrically with the disk-shaped detection gear body 79. The toothed portion 80 has a generally semicircular arcuate shape extending along about two thirds of the circumference of the cylindrical portion 74. The toothed portion 80 is meshed with the agitator gear outer teeth 177 of the agitator driving gear 169, so that the driving force from the motor 56 is transmitted to the toothed portion 80.

The non-toothed portion 81 has a generally semicircular arcuate shape extending along about one third of the circumference of the cylindrical portion 74, and is defined as a part of the cylindrical portion 74 other than the toothed portion 80. The non-toothed portion 81 is not meshed with the agitator gear outer teeth 177 of the agitator driving gear 169, thereby preventing the transmission of the driving force from the motor 56.

As shown in FIG. 6, an endless guide rail 97 is provided on the left surface of the disk-shaped detection gear body 79 as projecting laterally outward and surrounding the outer periphery of the detection gear support shaft 78. The guide rail 97 includes a generally semicircular arcuate portion 70 concentric with the detection gear support shaft 78, and an angled portion 99 of a generally M-shape connected to opposite ends of the generally semicircular arcuate portion 70 and having two vertices located on a radially outward portion of the disk-shaped detection gear body 79.

The abutment projections 82 each have a columnar shape, and projects laterally outward (to the left side) from the generally semicircular arcuate portion 70 of the guide rail 97.

The number of the abutment projections 82 provides information on the developer cartridge 32, i.e., information indicating a maximum number of sheets 3 on which the image formation can be performed with the use of the toner contained in the toner containing chamber 92 of the new developer cartridge 32 (hereinafter referred to as "maximum image formation sheet number").

More specifically, where two abutment projections 82 are provided as shown in FIG. 6 and FIGS. 12(*a*-1) to 12(*b*-2), for example, this provides information indicating that the maximum image formation sheet number is 6000. Where a single abutment projection 82 is provided as shown in FIGS. 13-1 and 13-2, this provides information indicating that the maximum image formation sheet number is 3000.

A positional relationship between the abutment projections 82 and the toothed portion 80 is determined so that the abutment projections 82 can abut against a lever 91 (transmission member) to be described later when the rotation of the detection gear 170 is permitted, i.e., the toothed portion 80 is meshed with the agitator gear outer teeth 177 of the agitator driving gear 169. More specifically, as shown in FIG. 6, a leading one of the two abutment projections 82 located rotationally downstream of the detection gear 170 is opposed to a generally middle part of the toothed portion 80 provided along the circumference of the detection gear body 79. The other trailing abutment projection 82 located rotationally upstream of the detection gear 170 is opposed to an outer portion of a rotationally upstream end of the toothed portion 80 provided along the circumference of the detection gear body 79.

The detection gear 170 is biased by a coil spring 96 so that the rotationally downstream end of the toothed portion 80 of the detection gear 170 is meshed with the agitator gear outer teeth 177 of the agitator driving gear 169 with the detection gear support shaft 78 being inserted in the insertion portion 77 of the detection gear body 79 in a relatively rotatable manner.

The coil spring 96 is wound around a boss 98 projecting laterally outward (to the left side) from the left side wall 141. One end of the coil spring 96 is fixed to the left side wall 141, and the other end of the coil spring 96 is engaged with one of the vertices of the angled portion 99 of the detection gear body 79. Thus, the coil spring 96 constantly biases the detection gear 170 in such a direction that the rotationally downstream end of the toothed portion 80 of the detection gear 170 is biased toward the agitator gear outer teeth 177 of the agitator driving gear 169 into mesh-engagement with the agitator gear outer teeth 177. Therefore, the rotationally downstream end of the toothed portion 80 of the detection gear 170 and the agitator gear outer teeth 177 of the agitator driving gear 169 are meshed with each other even when the developer cartridge 32 is new.

As shown in FIG. 5, the gear cover 164 is attached to the left side wall 141 of the developer cartridge 32 as covering the gear mechanism 163. In a lower portion of the gear cover 164, a gear cover opening 86 is formed for exposing the coupling receiving portion 172. Further, a detection gear cover portion 87 which covers the detection gear 170 is provided on an upper portion of the gear cover 164.

The detection gear cover portion 87 is bulged laterally outward (to the left side) so as to accommodate the detection gear 170, and a generally fan-shaped detection window 88 is formed on a rear side of the detection gear cover portion 87 for exposing the abutment projections 82 which are moved circumferentially by the rotation of the detection gear 170.

(2) Construction of Drum Subunits

As shown in FIG. 8, the drum subunits 46 each include a pair of side frames 47 disposed in laterally opposed spaced relation, and a center frame 48 held between the side frames 47.

The side frames 47 are generally rectangular plates each having a generally parallelogram shape inclined from an upper front side to a lower rear side as seen in elevation.

In laterally opposed inner surfaces of each side frame 47, guide grooves 49 are formed for guiding the developer cartridge 32 with respect to the drum subunit 46 for the mounting and demounting of the developer cartridge 32.

The guide groove 49 formed in each of the inner surfaces of the side frames 47 generally vertically extends from a rear portion of an upper edge of the side frame 47 to the vicinity of a front portion of a lower edge of the side frame 47. An upper end of the guide groove 49 opens upward and has a greater width. A lower end (innermost end) of the guide groove 49 is located in association with the developer roller shaft 157 when the developer cartridge 32 is mounted in the drum subunit 46 with the developer roller 67 in contact with the photosensitive drum 42.

In the side frame 47 located on the left side, an inner coupling insertion hole 117 is formed in a middle portion of the guide groove 49 as opposed widthwise to the coupling passive gear 165 of the developer cartridge 32 when the developer cartridge 32 is mounted in the drum subunit 46.

The side frames 47 each have a boss 52 provided in an upper portion thereof on the front side of the guide groove 49. The bosses 52 of the respective side frames 47 each have a hollow cylindrical shape, and are opposed widthwise to the windows 142 of the developer cartridge 32 when the developer cartridge 32 is mounted in the drum subunit 46.

As shown in FIG. 4, in the side plates 53 provided in pair, outer coupling insertion holes 118 opposed widthwise to the inner coupling insertion holes 117, and light transmission holes 119 opposed widthwise to the bosses 52 are respectively formed.

As shown in FIGS. 7 and 8, in the left side frame 47, a side wall slot 100 having an elongated rectangular shape as seen in elevation and provided in a vertically middle portion of the left side frame 47 between the guide groove 49 and the boss 52 as extending vertically, is further formed. A cylindrical lever support shaft 102 is provided at an upper end of the side wall slot 100 between a front edge and a rear edge of the side wall slot 100. The lever 91 is supported swingably about the lever support shaft 102 in the widthwise direction perpendicular to the side frame 47. That is, as shown in FIGS. 9(*a*-1) to 9(*b*-4), the lever 91 has a generally T-shaped cross section having three ends. A support portion 103 having a generally C-shaped cross section is provided at a first end of the lever 91. A generally C-shaped opening of the support portion 103 is engaged with the lever support shaft 102, whereby the lever 91 is supported swingably about the lever support shaft 102. Further, a generally L-shaped abutment portion 104 as seen in section which abutment projections 82 of the detection gear 170 is brought into abutment against, is formed at a second end of the lever 91, and a detection portion 105 of a thick plate to be detected by an optical sensor 85 to be described later is formed at a third end of the lever 91. The support portion 103 of the lever 91 is supported by the lever support shaft 102. When no external force acts on the lever 91 (in a normal state), the detection portion 105 of the lever 91 is located below the support portion 103 by its own weight and extends laterally outward through the side wall slot 100, and the abutment portion 104 of the lever 91 is located on a laterally inner side (right side) of the support portion 103.

(3) Construction of Main Body Casing

The optical sensor 85 (detection unit) (see FIGS. 9(*a*-1) to 9(*b*-4)) and a CPU 90 (information judging unit) (see FIG. 1) for detecting and judging information on the mounted developer cartridge 32, more specifically, information indicating whether or not the mounted developer cartridge 32 is new and information on the maximum image formation sheet number of the new developer cartridge 32 are provided in the main body casing 2.

The optical sensor 85 is provided on a board 216 attached to an inner surface (right side) of a left side wall of the main body casing 2. As shown in FIGS. 9(*a*-1) to 9(*a*-4), the optical sensor 85 is disposed in laterally opposed spaced relation to the detection gear 170 of the developer cartridge 32 mounted in the main body casing 2 and the lever 91 of the drum subunit 46.

The optical sensor 85 includes a light emitting element 94 and a light receiving element 95.

The optical sensor 85 has a U-shaped cross section. A bottom of the U-shaped optical sensor 85 is fixed to a right surface of the board 216, and the light emitting element 94 and the light receiving element 95 are respectively provided at opposite end portions of the optical sensor 85 in opposed spaced relation.

In the optical sensor 85, detection light emitted from the light emitting element 94 is received by the light receiving element 95 when the lever 91 is in the normal state (when no external force acts on the lever 91, as described above) as shown in FIGS. 9(*a*-1) to 9(*a*-4). On the other hand, when either of the abutment projections 82 abuts against the abutment portion 104 to swing the lever 91 about the lever support shaft 102, the detection portion 105 is swung upward laterally outward, whereby the detection light emitted from the light emitting element 94 is blocked by the detection portion 105 and is not detected by the light receiving element 95 as shown in FIGS. 9(*b*-1) to 9(*b*-4).

The CPU 90 is connected to the optical sensor 85. When the light receiving element 95 of the optical sensor 85 receives the detection light, a light reception signal is inputted to the CPU 90 from the optical sensor 85. When the detection light is blocked and is not received by the light receiving element 95, a light block signal is inputted to the CPU 90 from the optical sensor 85.

3. Operation for Detection of New Developer Cartridge

Next, a method for judging whether or not the developer cartridge 32 mounted in the main body casing 2 is new and determining the maximum image formation sheet number of the new developer cartridge 32 will be described.

(1) Developer Cartridges Each Having Two Abutment Projections

New developer cartridges 32 (each having two abutment projections 82) for the respective colors are mounted in the corresponding color drum subunits 46 of the drum unit 10 as shown in FIG. 4. For mounting each of the developer cartridges 32 in the corresponding drum subunit 46, the axially opposite ends of the developer roller shaft 157 of the developer cartridge 32 are brought into engagement with the guide grooves 49 of the side frames 47 of the drum subunit 46 and inserted to the innermost ends of the guide grooves 49. Thus, the developer cartridge 32 is mounted in the drum subunit 46 with the developer roller 67 thereof in contact with the photosensitive drum 42.

Then, as shown in FIG. 1, the front cover 7 is opened, and the drum unit 10 mounted with the new developer cartridges 32 is mounted in the processing section accommodating section 12 of the main body casing 2.

With the developer cartridges 32 being each thus mounted, the leading abutment projection 82 of the detection gear 170 is separated from the abutment portion 104 of the lever 91 as shown in FIGS. 9(*a*-1) to 9(*a*-4). Therefore, the lever 91 is kept in the above-mentioned normal state.

With the developer cartridges 32 being each mounted in the main body casing 2, as shown in FIG. 6 a coupling insertion portion (not shown) to which the driving force from the motor 56 (driving unit) provided in the main body casing 2 is transmitted is inserted in the coupling receiving portion 172 of the coupling passive gear 165 of the developer cartridge 32 through the inner coupling insertion hole 117 and the outer coupling insertion hole 118. This makes it possible to drive the coupling passive gear 165, the supply roller driving gear 166, the developer roller driving gear 167, the intermediate gear 190, the agitator driving gear 169 and the detection gear 170 of the gear mechanism 163.

Then, a warm-up operation is started to perform an initial turning operation to rotate the agitator 69 by the control of the CPU 90 in the color laser printer 1.

In the initial turning operation, the motor 56 provided in the main body casing 2 is driven by the control of the CPU 90, and the driving force of the motor 56 is inputted to the coupling passive gear 165 via the coupling receiving portion 172 in the developer cartridge 32, whereby the coupling passive gear 165 is rotatively driven. Then, the supply roller driving gear 166 meshed with the coupling passive gear 165 is rotatively driven, and the supply roller 66 is rotated by the rotation of the supply roller shaft 155. Further, the developer roller driving gear 167 meshed with the coupling passive gear 165 is rotatively driven, and the developer roller 67 is rotated by the rotation of the developer roller shaft 157. Further, the intermediate gear outer teeth 174 of the intermediate gear 190 meshed with the coupling passive gear 165 are rotatively driven, and the intermediate gear inner teeth 175 of the intermediate gear 190 formed integrally with the intermediate gear outer teeth 174 are rotatively driven. With the intermediate gear inner teeth 175 of the intermediate gear 190 being rotatively driven, the agitator gear inner teeth 176 of the agitator driving gear 169 meshed with the intermediate gear inner teeth 175 of the intermediate gear 190 are rotatively driven, and the agitator 69 is rotated by the rotation of the rotation shaft 151. By the rotation of the agitator 69, the toner in the toner containing chamber 92 is agitated to be fluidized.

When the agitator gear inner teeth 176 of the agitator driving gear 169 are rotatively driven, the agitator gear outer teeth 177 of the agitator driving gear 169 formed integrally with the agitator gear inner teeth 176 are rotatively driven. Then, the detection gear 170 with the toothed portion 80 meshed with the agitator gear outer teeth 177 of the agitator driving gear 169 is rotatively driven by a predetermined driving amount from the start of the rotative driving to the end of the rotative driving.

That is, the toothed portion 80 of the detection gear 170 is meshed with the agitator gear outer teeth 177 of the agitator driving gear 169 at the rotationally downstream end thereof by the biasing force of the coil spring 96, and the detection gear 170 is rotatively driven in an arrow direction X as shown in FIGS. 9(*a*-1) to 9(*a*-4) only by a distance between the rotationally upstream end and the rotationally downstream end of the toothed portion 80. The detection gear 170 is driven in one direction along the toothed portion 80 to make an about ⅔ turn about the detection gear support shaft 78, and then stopped. After the stop of the detection gear 170, the other end of the coil spring 96 is engaged with the other vertex of the angled portion 99 of the detection gear body 79, whereby the detection gear 170 is kept still. When the rotation of the detection gear 170 is stopped, the rotation restricting claw 89 provided on the outer peripheral portion of the detection gear body 79 is located rotationally upstream of a rotation restriction stopper 76 projecting laterally outward (to the left side) from the side wall 141 (see FIG. 10(*e*-4)). Therefore, the rotation of the detection gear 170 having the rotation restricting claw 89 in the arrow direction X is restricted by the rotation restriction stopper 76.

When the rotative driving of the detection gear 170 is started, as shown in FIGS. 9(*b*-1) to 9(*b*-4), the leading abutment projection 82 of the detection gear 170 is first brought into abutment against the abutment portion 104 of the lever 91 in the normal state downward from the upper side. Then, the lever 91 is swung about the lever support shaft 102 to move the abutment portion 104 downward and move the detection portion 105 upward and laterally outward (to the left side), whereby the detection portion 105 is located between the light emitting element 94 and the light receiving element 95 of the optical sensor 85. Thus, the detection light which is received by the light receiving element 95 when the lever 91 is in the normal state is blocked by the detection portion 105 of the lever 91.

Then, the light block signal based on the blocking of the light is transmitted from the optical sensor 85 to the CPU 90. The CPU 90 detects this light block signal as the first light block signal, and resets a counter.

Figure 10:
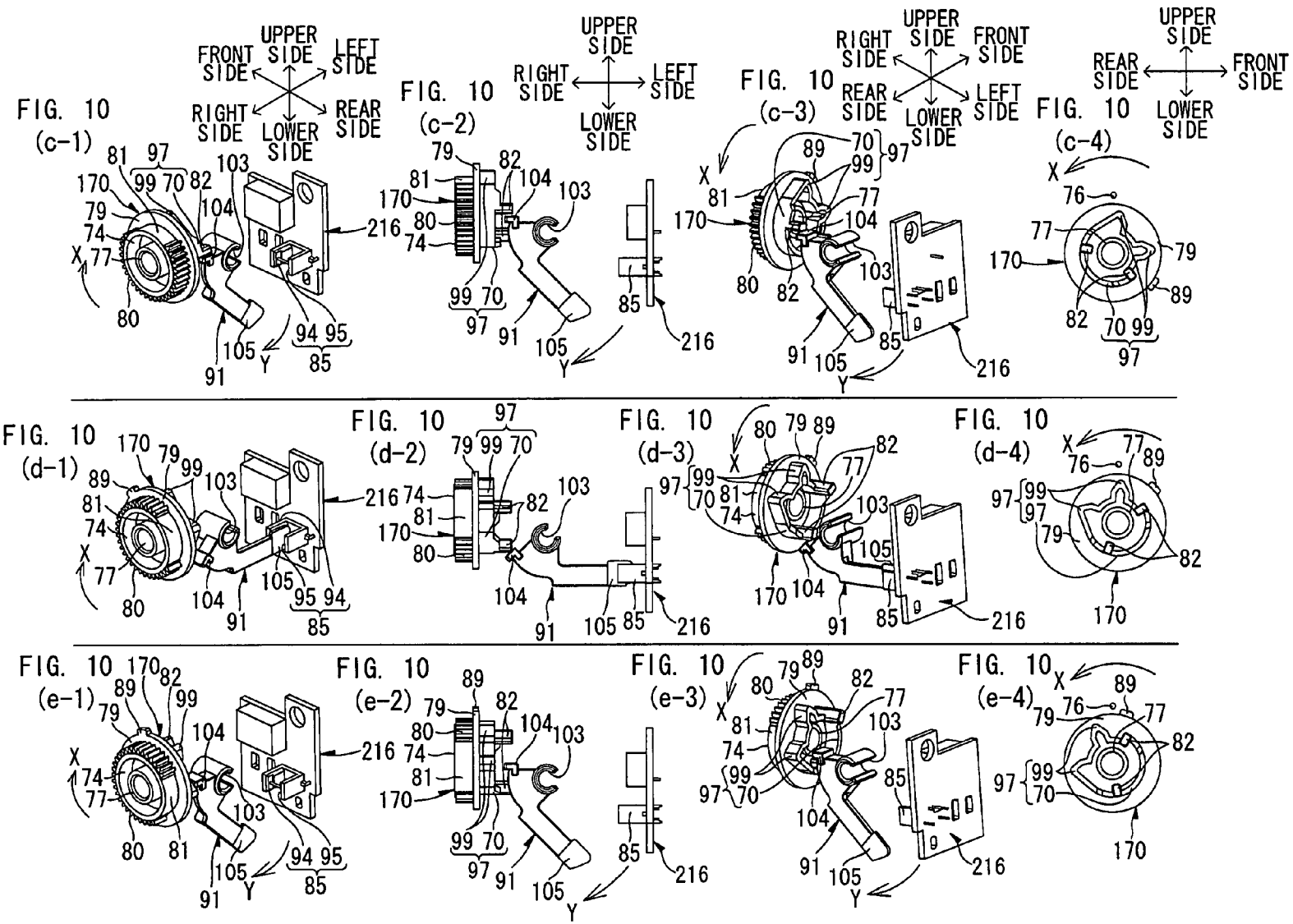
FIGS. 10(*c*-1), 10(*d*-1) and 10(*e*-1), FIGS. 10(*c*-2), 10(*d*-2) and 10(*e*-2), FIGS. 10(*c*-3), 10(*d*-3) and 10(*e*-3), and FIGS. 10(*c*-4), 10(*d*-4) and 10(*e*-4) are perspective views as seen from the toothed portion side, rear views, perspective views as seen from the abutment projection side and side views of the detection gear, respectively, for explaining the operation of the new cartridge detection mechanism (having two abutment projections) particularly, FIGS. 10(*c*-1) to 10(*c*-4) illustrating a state after the leading abutment projection passes over the lever, FIGS. 10(*d*-1) to 10(*d*-4) illustrating a state with a trailing abutment projection in abutment against the lever, and FIGS. 10(*e*-1) to 10(*e*-4) illustrating a state after the trailing abutment projection passes over the lever.

Thereafter, the leading abutment projection 82 is slid along the abutment portion 104 to further press the abutment portion 104, and then separated from the abutment portion 104 to pass over the abutment portion 104 as shown in FIGS. 10(*c*-1) to 10(*c*-4). When the abutment projection 82 is thus brought out of abutment against the abutment portion 104, the lever 91 is swung about the lever support shaft 102 by its own weight to move the abutment portion 104 upward and move the detection portion 105 downward and laterally inward (in an arrow direction Y), whereby the lever 91 is returned to the normal state.

When the detection gear 170 is thereafter further rotatively driven, the trailing abutment projection 82 is brought into abutment against the abutment portion 104 of the lever 91 in the normal state downward from the upper side. Then, as shown in FIGS. 10(*d*-1) to 10(*d*-4), the lever 91 is swung again about the lever support shaft 102 to move the abutment portion 104 downward and move the detection portion 105 upward and laterally outward, whereby the detection portion 105 is moved to a position between the light emitting element 94 and the light receiving element 95 of the optical sensor 85 to block the detection light. The light block signal based on the blocking of the light is transmitted to the CPU 90 from the optical sensor 85. The CPU 90 detects this light block signal as the second light block signal.

Thereafter, the trailing abutment projection 82 is slid along the abutment portion 104 to further press the abutment portion 104, and then separated from the abutment portion 104 to pass over the abutment portion 104 as shown in FIGS. 10(*e*-1) to 10(*e*-4). When the abutment projection 82 is thus brought out of abutment against the abutment portion 104, the lever 91 is swung about the lever support shaft 102 by its own weight to move the abutment portion 104 upward and move the detection portion 105 laterally inward (in the arrow direction Y), whereby the lever 91 is returned to the normal state.

After the toothed portion 80 of the detection gear 170 is brought out of mesh-engagement with the agitator gear outer teeth 177 of the agitator driving gear 169 to stop the rotative driving of the detection gear 170, the warm-up operation including the initial turning operation ends.

In the initial turning operation, the CPU 90 judges whether or not the mounted developer cartridge 32 is new on the basis of the absence or presence of the input of the light block signal, and determines the maximum image formation sheet number of the developer cartridge 32 on the basis of the number of the inputted light block signals.

That is, when the CPU 90 detects the first light block signal as described with reference to FIGS. 9(*a*-1) to 9(*b*-4) and FIGS. 10(*c*-1) to 10(*e*-4), the CPU 90 judges that the developer cartridge 32 is new.

In the CPU 90, the information on the maximum image formation sheet number is predefined by the number of the inputted light block signals. More specifically, the information is predefined so that the maximum image formation sheet number is 6000 where the number of the inputted light block signals is two, and the maximum image formation sheet number is 3000 where the number of the inputted light block signals is one.

When the CPU 90 detects the two light block signals, i.e., the first and second light block signals, before the end of the initial turning operation as described with reference to FIGS. 9(*a*-1) to 9(*b*-4) and FIGS. 10(*c*-1) to 10(*e*-4), the CPU 90 judges that the maximum image formation sheet number of the new developer cartridge 32 is 6000.

As a result, the CPU 90 judges that the mounted developer cartridge 32 is new and the maximum image formation sheet number of the new developer cartridge 32 is 6000 in the case of FIGS. 9(*a*-1) to 9(*b*-4) and FIGS. 10(*c*-1) to 10(*e*-4). Immediately before the number of sheets actually used for the image formation as counted by a sheet ejection sensor (not shown) after the mounting of the new developer cartridge 32 exceeds 6000, the CPU 90 displays a "toner empty" warning message on an operation panel (not shown) or the like.

On the other hand, where the developer cartridges 32 are once demounted together with the drum unit 10 from the processing section accommodating section 12 of the main body casing 2 after the mounting of the new developer cartridges 32 and remounted together with the drum unit 10 in the processing section accommodating section 12 of the main body casing 2, for example, for recovery from sheet jam, the detection gear 170 is kept still with the toothed portion 80 thereof being out of mesh-engagement with the agitator gear outer teeth 177 of the agitator driving gear 169 (i.e., with the non-toothed portion 81 thereof being opposed to the agitator gear outer teeth 177 of the agitator driving gear 169). Therefore, even if the initial turning operation is performed by the control of the CPU 90 after the remounting, the detection gear 170 is not rotatively driven, so that neither of the abutment projections 82 abuts against the abutment portion 104 of the lever 91. Hence, no light block signal is inputted to the CPU 90 from the optical sensor 85. Accordingly, there is no possibility that the CPU 90 erroneously judges that the remounted developer cartridge 32 (used developer cartridge) is new. Further, the CPU 90 continuously compares the number of the sheets actually used for the image formation as counted from the time of the new cartridge judgment with the maximum image formation sheet number determined at the new cartridge judgment.

(2) Developer Cartridges Each Having Single Abutment Projection

In the same manner as described above, the front cover 7 is first opened, and the drum unit 10 mounted with the new developer cartridges 32 (each having a single abutment projection 82) is mounted in the processing section accommodating section 12 of the main body casing 2.

As shown in FIGS. 13-1 and 13-2, the detection gear 170 of each of the developer cartridges 32 includes a single abutment projection 82 corresponding to the leading one of the two abutment projections 82 shown in FIGS. 9(*a*-1) to 9(*b*-4), FIGS. 10(*c*-1) to 10(*e*-4) and FIGS. 12(*a*-1) to 12(*b*-2), but does not include an abutment projection 82 corresponding to the trailing abutment projection 82.

Figure 11:
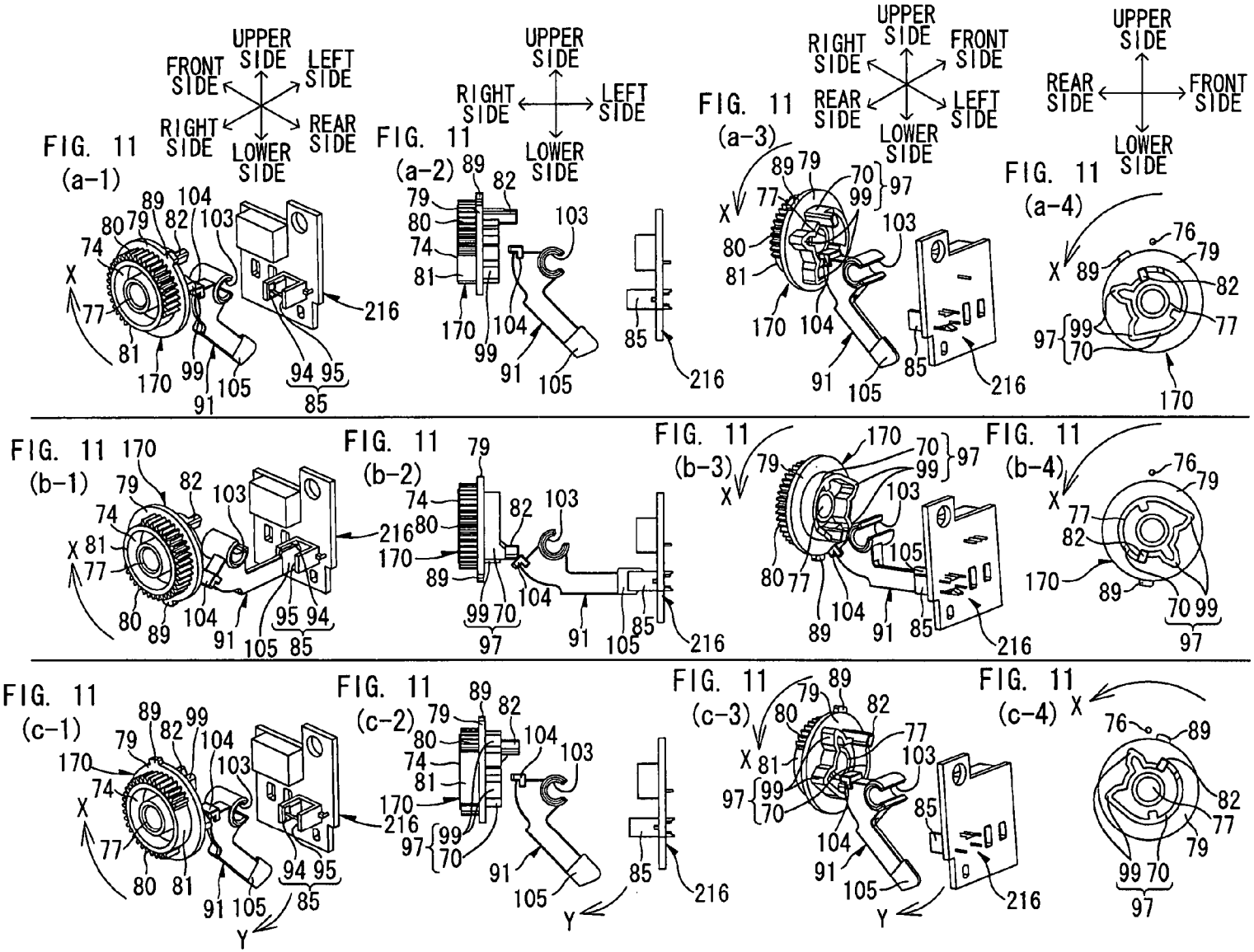
FIGS. 11(*a*-1), 11(*b*-1) and 11(*c*-1), FIGS. 11(*a*-2), 11(*b*-2) and 11(*c*-2), FIGS. 11(*a*-3), 11(*b*-3) and 11(*c*-3), and FIGS. 11(*a*-4), 11(*b*-4) and 11(*c*-4) are perspective views as seen from the toothed portion side, rear views, perspective views as seen from the abutment projection side and side views of a detection gear, respectively, for explaining the operation of a new cartridge detection mechanism (having a single (narrow) abutment projection), particularly, FIGS. 11(*a*-1) to 11(*a*-4) illustrating a state before the developer cartridge is mounted in the main body casing, FIGS. 11(*b*-1) to 11(*b*-4) illustrating a state with the abutment projection in abutment against the lever after the developer cartridge is mounted in the main body casing, and FIGS. 11(*c*-1) to 11(*c*-4) illustrating a state after the abutment projection passes over the lever.

With the developer cartridges 32 being each thus mounted, the leading abutment projection 82 of the detection gear 170 is separated from the abutment portion 104 of the lever 91 in the normal state as shown in FIG. 11(*a*-1) to 11(*a*-4). Therefore, the lever 91 is kept in the above-mentioned normal state.

With the developer cartridges 32 being each mounted in the main body casing 2, the coupling insertion portion (not shown) to which the driving force from the motor 56 provided in the main body casing 2 is transmitted is inserted in the coupling receiving portion 172 of the coupling passive gear 165 of the developer cartridge 32 through the inner coupling insertion hole 117 and the outer coupling insertion hole 118. This makes it possible to drive the coupling passive gear 165, the supply roller driving gear 166, the developer roller driving gear 167, the intermediate gear 190, the agitator driving gear 169 and the detection gear 170 of the gear mechanism 163.

Then, the warm-up operation is started to perform the initial turning operation to rotate the agitator 69 by the control of the CPU 90 in the color laser printer 1 as in the aforesaid case.

In the initial turning operation, the detection gear 170 is rotatively driven as in the aforesaid case only when the toothed portion 80 thereof is meshed with the agitator gear outer teeth 177 of the agitator driving gear 169. Therefore, the detection gear 170 is driven along the toothed portion 80 in one direction to make an about ⅔ turn about the detection gear support shaft 78, and then stopped. After the stop of the detection gear 170, the other end of the coil spring 96 is engaged with the other vertex of the angled portion 99 of the detection gear body 79, whereby the detection gear 170 is kept still. The rotation of the detection gear 170 having the rotation restricting claw 89 in the arrow direction X is restricted by the rotation restriction stopper 76 as in the aforesaid case.

When the rotative driving of the detection gear 170 is started, as shown in FIGS. 11(*b*-1) to 11(*b*-4), the abutment projection 82 of the detection gear 170 is brought into abutment against the abutment portion 104 of the lever 91 in the normal state downward from the upper side. Then, the lever 91 is swung about the lever support shaft 102 to move the abutment portion 104 downward and move the detection portion 105 upward and laterally outward (to the left side), whereby the detection portion 105 is located between the light emitting element 94 and the light receiving element 95 of the optical sensor 85. Thus, the detection light which is received by the light receiving element 95 when the lever 91 is in the normal state is blocked by the detection portion 105 of the lever 91.

Then, the light block signal based on the blocking of the light is transmitted from the optical sensor 85 to the CPU 90. The CPU 90 detects this light block signal as the first light block signal, and resets the counter.

Thereafter, the abutment projection 82 is slid along the abutment portion 104 to further press the abutment portion 104, and then separated from the abutment portion 104 to pass over the abutment portion 104 as shown in FIGS. 11(*c*-1) to 11(*c*-4). When the abutment projection 82 is thus brought out of abutment against the abutment portion 104, the lever 91 is swung about the lever support shaft 102 by its own weight to move the abutment portion 104 upward and move the detection portion 105 downward and laterally inward (in the arrow direction Y), whereby the lever 91 is returned to the normal state.

After the toothed portion 80 of the detection gear 170 is brought out of mesh-engagement with the agitator gear outer teeth 177 of the agitator driving gear 169 to stop the rotative driving of the detection gear 170, the warm-up operation including the initial turning operation ends.

In the initial turning operation, the CPU 90 judges whether or not the mounted developer cartridge 32 is new on the basis of the absence or presence of the input of the light block signal, and determines the maximum image formation sheet number of the developer cartridge 32 on the basis of the number of the inputted light block signals, as in the aforesaid case.

That is, when the CPU 90 detects the first light block signal in the case of FIGS. 11(*a*-1) to 11(*c*-4), the CPU 90 judges that the developer cartridge 32 is new.

Further, when the CPU 90 detects the first light block signal, i.e., the single light block signal, before the end of the initial turning operation in the case of FIGS. 11(*a*-1) to 11(*c*-4), the CPU 90 judges that the maximum image formation sheet number of the new developer cartridge 32 is 3000.

As a result, the CPU 90 judges that the mounted developer cartridge 32 is new and the maximum image formation sheet number of the developer cartridge 32 is 3000 in the case of FIGS. 11(*a*-1) to 11(*c*-4). Before the number of sheets actually used for the image formation as counted by the sheet ejection sensor (not shown) after the mounting of the new developer cartridge 32 exceeds 3000, the CPU 90 displays a "toner empty" warning message on the operation panel (not shown) or the like.

On the other hand, where the developer cartridges 32 are once demounted together with the drum unit 10 from the processing section accommodating section 12 of the main body casing 2 after the mounting of the new developer cartridges 32 and remounted together with the drum unit 10 into the processing section accommodating section 12 of the main body casing 2, for example, for recovery from sheet jam, the detection gear 170 is kept still with the toothed portion 80 thereof being out of mesh-engagement with the agitator gear outer teeth 177 of the agitator driving gear 169 (i.e., with the non-toothed portion 81 thereof being opposed to the agitator gear outer teeth 177 of the agitator driving gear 169). Therefore, even if the initial turning operation is performed by the control of the CPU 90 after the remounting, the detection gear 170 is not rotatively driven, so that the abutment projection 82 does not abut against the abutment portion 104 of the lever 91. Hence, no light receiving signal is inputted to the CPU 90 from the optical sensor 85. Accordingly, there is no possibility that the CPU 90 erroneously judges that the remounted developer cartridge 32 (used developer cartridge) is new. Further, the CPU 90 continuously compares the number of the sheets actually used for the image formation as counted from the time of the new cartridge judgment with the maximum image formation sheet number determined at the new cartridge judgment.

4. Effects of Detection of New Developer Cartridge

When the drum unit 10 mounted with the developer cartridges 32 is mounted in the processing section accommodating section 12 of the main body casing 2 of the color laser printer 1, the detection gear 170 of each of the developer cartridges 32 is rotatively driven to make an about ⅔ turn from the start of the rotative driving to the end of the rotative driving by the motor 56 provided in the main body casing 2. As the detection gear 170 is rotatively driven, the abutment projection 82 is circumferentially moved into abutment against the abutment portion 104 of the lever 91 provided in the drum subunit 46. Thus, the lever 91 is swung about the lever support shaft 102, so that the detection portion 105 is moved to the position between the light emitting element 94 and the light receiving element 95 of the optical sensor 85 provided in the main body casing 2. The movement of the detection portion 105 is detected by the optical sensor 85. Then, the CPU 90 judges whether or not the developer cartridge 32 is new on the basis of the absence or presence of the detection of the lever 91 by the optical sensor 85. Therefore, whether or not the developer cartridge 32 is new can be judged with a simple construction at reduced costs.

In the color laser printer 1, the developer cartridges 32 are mounted in the drum unit 10, and spaced widthwise from the side walls of the main body casing 2. On the other hand, the abutment projection 82 of the developer cartridge 32 is brought into abutment against the lever 91 which is swingable in the widthwise direction, and the widthwise swinging of the lever 91 is detected by the optical sensor 85. Thus, the CPU 90 can reliably judge whether or not the developer cartridge 32 is new. Further, there is no need to eliminate widthwise spaces defined between the developer cartridges 32 and the main body casing 2 by increasing the size of the developer cartridges 32. Therefore, the size reduction of the color laser printer 1 including the developer cartridges 32 can be achieved.

Further, the abutment projection 82 is rotated anteroposteriorly, while the lever 91 is swung perpendicularly to the rotation direction of the abutment projection 82, i.e., in the widthwise direction (lateral direction). Therefore, the developer cartridges 32 can be spaced a greater distance laterally from the side walls of the main body casing 2, so that the design flexibility of the color laser printer 1 including the developer cartridges 32 can be increased.

In the color laser printer 1, the abutment projection 82 is brought into abutment against the abutment portion 104 of the lever 91. Where the abutment projection 82 includes a plurality of abutment projections 82, the plurality of abutment projections 82 can be each brought into abutment against the abutment portion 104. As a result, the detection portion 105 moved in association with the plurality of abutment projections 82 is detected by the optical sensor 85 and, on the basis of the results of the detection, the CPU 90 can judge whether or not the developer cartridge 32 is new, and further determine the maximum image formation sheet number of the new developer cartridge 32.

Further, the detection gear 170, which is a partly toothed gear, is rotatively driven while the driving force from the motor 56 is transmitted to the toothed portion 80 thereof, and the rotative driving of the detection gear 170 is stopped when the driving force from the motor 56 is not transmitted to the detection gear 170 with the non-toothed portion 81. Therefore, the detection gear 170 can be assuredly rotatively driven by the predetermined driving amount from the start of the rotative driving to the end of the rotative driving.

In the developer cartridge 32, the detection gear 170 is biased toward the agitator gear outer teeth 177 of the agitator driving gear 169 by the coil spring 96 so as to be meshed with the agitator gear outer teeth 177. Thus, the mesh engagement between the detection gear 170 and the agitator gear outer teeth 177 of the agitator driving gear 169 can be assuredly achieved. Therefore, the detection gear 170 is reliably driven via the agitator gear outer teeth 177 of the agitator driving gear 169 by the driving force from the motor 56. The reliable driving of the detection gear 170 makes it possible for the CPU 90 to reliably determine the maximum image formation sheet number of the developer cartridge 32 when the CPU 90 judges that the developer cartridge 32 is new.

In the color laser printer 1, one or two abutment projections 82 are provided in each of the developer cartridges 32, and the information on the maximum image formation sheet number of the developer cartridge 32 is predefined by the number of the abutment projections 82. Therefore, the CPU 90 can easily and reliably determine the information on the maximum image formation sheet number of the developer cartridge 32 on the basis of the number of the times of the detection of the lever 91 by the optical sensor 85 (the number of the inputted light block signals). Therefore, even if the amount of the toner contained in the developer cartridge 32 varies according to the maximum image formation sheet number, the service life of the developer cartridge 32 can be accurately determined, making it possible to replace the developer cartridge 32 at the appropriate time.

In the color laser printer 1, the CPU 90 judges whether or not the mounted developer cartridge 32 is new on the basis of the detection of the abutment projection 82 of the developer cartridge 32 by the optical sensor 85. Thus, the judgment on whether or not the developer cartridge 32 is new can be made easily and reliably. Therefore, the service life of the new developer cartridge 32 can be reliably determined.

Second Embodiment

In the first embodiment, the information on the maximum image formation sheet number of the developer cartridge 32 is predefined by the number of the abutment projections 82, but may be predefined by the width of the abutment projection 82 as shown in FIGS. 15-1 and 15-2.

For example, the abutment projection 82 is designed as having a greater width as shown in FIGS. 15-1 and 15-2 to provide information indicating that the maximum image formation sheet number is 6000, and as having a smaller width as shown in FIGS. 13-1 and 13-2 to provide information indicating that the maximum image formation sheet number is 3000.

The CPU 90 is adapted to determine the maximum image formation sheet number on the basis of duration of the light block signal inputted from the optical sensor 85 as measured from the start of the driving of the motor 56.

Where the abutment projection 82 of the detection gear 170 has a smaller width as shown in FIGS. 11(*a*-1) to 11(*c*-4), the optical sensor 85 inputs the light block signal to the CPU 90 for a shorter period of time during which the abutment projection 82 of the detection gear 170 in abutment against the abutment portion 104 of the lever 91 is slid along the abutment portion 104 as shown in FIGS. 11(*b*-1) to 11(*b*-4) to pass over the abutment portion 104 from the start of the rotative driving of the detection gear 170 in the initial turning operation.

On the other hand, where the abutment projection 82 of the detection gear 170 has a greater width as shown in FIGS. 14(*a*-1) to 14(*c*-2), the optical sensor 85 inputs the light block signal to the CPU 90 for a longer period of time during which the abutment projection 82 of the detection gear 170 in abutment against the abutment portion 104 of the lever 91 is slid along the abutment portion 104 (see FIGS. 14(*b*-1) and 14(*b*-2)) to pass over the abutment portion 104 (see FIGS. 14(*c*-1) and 14(*c*-2)) from the start of the rotative driving of the detection gear 170 (see FIGS. 14(*a*-1) and 14(*a*-2)) in the initial turning operation.

On the basis of the duration of the light block signal, the CPU 90 determines the maximum image formation sheet number. Where the light block period is shorter, for example, the CPU 90 determines that the maximum image formation sheet number is 3000. Where the light block period is longer, the CPU 90 determines that the maximum image formation sheet number is 6000.

The width of the abutment projection 82 is thus variably designed, whereby the CPU 90 can determine the maximum image formation sheet number of the developer cartridge 32 on the basis of the duration of the detection of the abutment projection 82 by the light emitting element 94.

Third Embodiment

In the first embodiment, the information indicating that the maximum image formation sheet number is 6000 is defined by the provision of the two abutment projections 82, and the information indicating that the maximum image formation sheet number is 3000 is defined by the provision of the single abutment projection 82. Alternatively, the information indicating that the maximum image formation sheet number is 6000 may be defined by the provision of the single abutment projection 82, and the information indicating that the maximum image formation sheet number is 3000 may be defined by the provision of the two abutment projections 82.

Although it is also possible to define the information on the maximum image formation sheet number of the developer cartridge 32 by the width of the abutment projection 82 as described above, the widths and number of the abutment projections 82 may be used in combination to define information other than the information on the maximum image formation sheet number. For example, the information on the maximum image formation sheet number may be defined by the width of the abutment projection 82 (e.g., the wider abutment projection 82 provides the information indicating that the maximum image formation sheet number is 6000, and the narrower abutment projection 82 provides the information indicating that the maximum image formation sheet number is 3000), and information on the color of the toner contained in the developer cartridge 32 may be defined by the number of the abutment projections 82. For example, information indicating that the toner color of the developer cartridge 32 is yellow may be defined by provision of a single abutment projection 82, and information indicating that the toner color is magenta may be defined by provision of two abutment projections 82. Information indicating that the toner color is cyan may be defined by provision of three abutment projections 82, and information indicating that the toner color is black may be defined by provision of four abutment projections 82. On the contrary, the information on the maximum image formation sheet number may be defined by the number of the abutment projections 82, and the information on the toner color may be defined by the width of the abutment projection 82. That is, the width of the abutment projection 82 of the developer cartridge 32 is variably designed for the plurality of toner colors, whereby the light block period detected by the optical sensor 85 when the light is blocked by the detection portion 105 of the lever 91 can be varied depending on the toner color of the developer cartridge 32.

In the embodiments described above, the developer cartridge 32 and the drum subunit 46 provided with the photosensitive drum 28 are provided as separate members. However, the developer cartridge according to the present invention may be provided unitarily with the drum subunit 46.

In the embodiments described above, the tandem color laser printer 1 adapted to transfer toner images onto a sheet 3 directly from the respective photosensitive drums 42 is provided by way of example, but the present invention is not limited to the tandem color laser printer. For example, the present invention may be embodied as a color laser printer of an intermediate transfer type, in which color toner images are once transferred from photosensitive drums onto an intermediate transfer member and then transferred together onto a sheet from the intermediate transfer member. Further, the present invention may be embodied as a monochrome laser printer. In the monochrome laser printer, a processing unit including a single developer cartridge 32 mounted in a single drum subunit 46 may be provided as an image formation unit.

While the three independent embodiments, i.e., the first, second and third embodiment, of the present invention have thus been described in detail, those skilled in the art may utilize the features of these three embodiments in combination to provide an image forming apparatus having the advantages of these embodiments.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus comprising:

an image forming apparatus body;

a photosensitive unit removably mounted in the image forming apparatus body and having an image carrier;

a developer cartridge which contains developer, the developer cartridge being removably mounted in the photosensitive unit and having a developer carrier;

a driving unit provided in the image forming apparatus body;

a drive member provided in the developer cartridge and permitted to be driven by the driving unit when the developer cartridge is mounted in the image forming apparatus body, consequently driven by a predetermined driving amount from start of the driving to end of the driving;

a movement member which is movable with the driving of the drive member;

a transmission member provided in the photosensitive unit and moved by abutment of the movement member against the transmission member;

a detection unit provided in the image forming apparatus body for detecting the movement of the transmission member; and a information judging unit which judges information on the developer cartridge on the basis of a result of the detection by the detection unit, wherein the drive member is a partly toothed gear which includes a toothed portion to which a driving force from the driving unit is transmitted, and a non-toothed portion to which the driving force from the driving unit is not transmitted.

2. The image forming apparatus as set forth in claim 1, wherein a plurality of the movement members are provided.

3. The image forming apparatus as set forth in claim 1, wherein the information on the developer cartridge is defined by the number of the movement members, and the information judging unit judges the information on the developer cartridge on the basis of the number of times of the detection by the detection unit.

4. The image forming apparatus as set forth in claim 1, wherein the information on the developer cartridge is defined by a width of the movement member as measured along its movement direction, and the information judging unit judges the information on the developer cartridge on the basis of duration of the detection by the detection unit.

5. The image forming apparatus as set forth in claim 1, wherein the information on the developer cartridge is information indicating whether or not the developer cartridge is new.

6. The image forming apparatus as set forth in claim 1, wherein the information on the developer cartridge is information indicating a maximum number of recording media on which image formation can be performed by using the developer.

7. The image forming apparatus as set forth in claim 1, wherein the transmission member is a lever.

8. The image forming apparatus as set forth in claim 1, wherein the transmission member is movable crossly to a direction of the movement of the movement member.

9. The image forming apparatus as set forth in claim 1, wherein a plurality of the photosensitive units and the developer cartridges are provided for different colors, and are mounted together in the image forming apparatus body or dismounted together from the image forming apparatus body.

10. An image forming unit comprising:

a photosensitive unit removably mounted in an image forming apparatus body and having an image carrier; and a developer cartridge which contains developer, the developer cartridge being removably mounted in the photosensitive unit and having a developer carrier, wherein the developer cartridge includes:

a drive member permitted to be driven by a driving unit provided in the image forming apparatus body when the developer cartridge is mounted in the image forming apparatus body, consequently driven by a predetermined driving amount from start of the driving to end of the driving; and a movement member which is movable with the driving of the drive member to be brought into abutment against a transmission member provided in the photosensitive unit to move the transmission member so that the movement of the transmission member is detected by a detection unit provided in the image forming apparatus body, wherein the drive member of the developer cartridge is a partly toothed gear which includes a toothed portion to which a driving force from the driving unit is transmitted, and a non-toothed portion to which the driving force from the driving unit is not transmitted.

11. The image forming unit as set forth in claim 10, wherein a plurality of the movement members are provided in the developer cartridge.

12. A developer cartridge which contains developer and has a developer carrier, removably mounted in a photosensitive unit which is removably mounted in an image forming apparatus body and has an image carrier, the developer cartridge comprising:

a drive member permitted to be driven by a driving unit provided in the image forming apparatus body when the developer cartridge is mounted in the image forming apparatus body, consequently driven by a predetermined driving amount from start of the driving to end of the driving; and a movement member which is movable with the driving of the drive member to be brought into abutment against a transmission member provided in the photosensitive unit to move the transmission member so that the movement of the transmission member is detected by a detection unit provided in the image forming apparatus body, wherein the drive member is a partly toothed gear which includes a toothed portion to which a driving force from the driving unit is transmitted, and a non-toothed portion to which the driving force from the driving unit is not transmitted.

13. The developer cartridge as set forth in claim 12, wherein a plurality of the movement members are provided.

14. An image forming apparatus comprising:

an image forming apparatus body;

a photosensitive unit removably mounted in the image forming apparatus body and having an image carrier;

a developer cartridge which contains developer, the developer cartridge being removably mounted in the photosensitive unit and having a developer carrier;

a driving unit provided in the image forming apparatus body;

a drive member provided in the developer cartridge and permitted to be driven by the driving unit when the developer cartridge is mounted in the image forming apparatus body, consequently driven by a predetermined driving amount from start of the driving to end of the driving;

a movement member which is movable with the driving of the drive member;

a transmission member provided in the photosensitive unit and moved by abutment of the movement member against the transmission member;

a detection unit provided in the image forming apparatus body for detecting the movement of the transmission member; and an information judging unit which judges information on the developer cartridge on the basis of a result of the detection by the detection unit, wherein the information on the developer cartridge is defined by the number of the movement members, and the information judging unit judges the information on the developer cartridge on the basis of the number of times of the detection by the detection unit.

15. The image forming apparatus as set forth in claim 14, wherein the information on the developer cartridge is information indicating whether or not the developer cartridge is new.

16. The image forming apparatus as set forth in claim 14, wherein the information on the developer cartridge is information indicating a maximum number of recording media on which image formation can be performed by using the developer.

17. The image forming apparatus as set forth in claim 14, wherein the transmission member is a lever.

18. The image forming apparatus as set forth in claim 14, wherein the transmission member is movable crossly to a direction of the movement of the movement member.

19. An image forming apparatus comprising:

an image forming apparatus body;

a photosensitive unit removably mounted in the image forming apparatus body and having an image carrier;

a developer cartridge which contains developer, the developer cartridge being removably mounted in the photosensitive unit and having a developer carrier;

a driving unit provided in the image forming apparatus body;

a drive member provided in the developer cartridge and permitted to be driven by the driving unit when the developer cartridge is mounted in the image forming apparatus body, consequently driven by a predetermined driving amount from start of the driving to end of the driving;

a movement member which is movable with the driving of the drive member;

a transmission member provided in the photosensitive unit and moved by abutment of the movement member against the transmission member;

a detection unit provided in the image forming apparatus body for detecting the movement of the transmission member; and an information judging unit which judges information on the developer cartridge on the basis of a result of the detection by the detection unit, wherein the information on the developer cartridge is defined by a width of the movement member as measured along its movement direction, and the information judging unit judges the information on the developer cartridge on the basis of the duration of the detection by the detection unit.

20. The image forming apparatus as set forth in claim 19, wherein the information on the developer cartridge is information indicating whether or not the developer cartridge is new.

21. The image forming apparatus as set forth in claim 19, wherein the information on the developer cartridge is information indicating a maximum number of recording media on which image formation can be performed by using the developer.

22. The image forming apparatus as set forth in claim 19, wherein the transmission member is a lever.

23. The image forming apparatus as set forth in claim 19, wherein the transmission member is movable crossly to a direction of the movement of the movement member.

24. An image forming apparatus comprising:

an image forming apparatus body;

a photosensitive unit removably mounted in the image forming apparatus body and having an image carrier;

a developer cartridge which contains developer, the developer cartridge being removably mounted in the photosensitive unit and having a developer carrier;

a driving unit provided in the image forming apparatus body;

a drive member provided in the developer cartridge and permitted to be driven by the driving unit when the developer cartridge is mounted in the image forming apparatus body, consequently driven by a predetermined driving amount from start of the driving to end of the driving;

a movement member which is movable with the driving of the drive member;

a transmission member provided in the photosensitive unit and moved by abutment of the movement member against the transmission member;

a detection unit provided in the image forming apparatus body for detecting the movement of the transmission member; and an information judging unit which judges information on the developer cartridge on the basis of a result of the detection by the detection unit, wherein the information on the developer cartridge is information indicating a maximum number of recording media on which image formation can be performed by using the developer.

25. The image forming apparatus set forth in claim 24, wherein the information on the developer cartridge is information indicating whether or not the developer cartridge is new.

26. The image forming apparatus as set forth in claim 24, wherein the transmission member is a lever.

27. The image forming apparatus as set forth in claim 24, wherein the transmission member is movable crossly to a direction of the movement of the movement member.

28. An image forming apparatus comprising:

an image forming apparatus body;

a photosensitive unit removably mounted in the image forming apparatus body and having an image carrier;

a developer cartridge which contains developer, the developer cartridge being removably mounted in the photosensitive unit and having a developer carrier;

a driving unit provided in the image forming apparatus body;

a drive member provided in the developer cartridge and permitted to be driven by the driving unit when the developer cartridge is mounted in the image forming apparatus body, consequently driven by a predetermined driving amount from start of the driving to end of the driving;

a movement member which is movable with the driving of the drive member;

a transmission member provided in the photosensitive unit and moved by abutment of the movement member against the transmission member;

a detection unit provided in the image forming apparatus body for detecting the movement of the transmission member; and an information judging unit which judges information on the developer cartridge on the basis of a result of the detection by the detection unit, wherein the transmission member is a lever.

29. The image forming apparatus as set forth in claim 28, wherein the information on the developer cartridge is information indicating whether or not the developer cartridge is new.

30. The image forming apparatus as set forth in claim 28, wherein the information on the developer cartridge is information indicating a maximum number of recording media on which image formation can be performed by using the developer.

31. The image forming apparatus as set forth in claim 28, wherein the transmission member is movable crossly to a direction of the movement of the movement member.

32. An image forming apparatus comprising:

an image forming apparatus body;

a photosensitive unit removably mounted in the image forming apparatus body and having an image carrier;

a developer cartridge which contains developer, the developer cartridge being removably mounted in the photosensitive unit and having a developer carrier;

a driving unit provided in the image forming apparatus body;

a drive member provided in the developer cartridge and permitted to be driven by the driving unit when the developer cartridge is mounted in the image forming apparatus body, consequently driven by a predetermined driving amount from start of the driving to end of the driving;

a movement member which is movable with the driving of the drive member;

a transmission member provided in the photosensitive unit and moved by abutment of the movement member against the transmission member;

a detection unit provided in the image forming apparatus body for detecting the movement of the transmission member; and an information judging unit which judges information on the developer cartridge on the basis of a result of the detection by the detection unit, wherein the transmission member is movable crossly to a direction of the movement of the movement member.

* * * * *